US006799164B1

(12) United States Patent
Araki

(10) Patent No.: US 6,799,164 B1
(45) Date of Patent: Sep. 28, 2004

(54) METHOD, APPARATUS, AND MEDIUM OF DIGITAL ACOUSTIC SIGNAL CODING LONG/SHORT BLOCKS JUDGEMENT BY FRAME DIFFERENCE OF PERCEPTUAL ENTROPY

(75) Inventor: Tadashi Araki, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 787 days.

(21) Appl. No.: 09/633,290

(22) Filed: Aug. 4, 2000

(30) Foreign Application Priority Data

Aug. 5, 1999 (JP) ..... 11-222054

(51) Int. Cl.[7] ..... G10L 19/14
(52) U.S. Cl. ..... 704/500; 704/200.1; 704/229
(58) Field of Search ..... 704/500, 501, 704/200.1, 204, 229, 230

(56) References Cited

U.S. PATENT DOCUMENTS 5,537,510 A * 7/1996 Kim ..... 704/229
5,627,937 A * 5/1997 Kim ..... 704/229
5,627,938 A 5/1997 Johnston
5,699,479 A * 12/1997 Allen et al. ..... 704/205

FOREIGN PATENT DOCUMENTS

EP 0 986 047 3/2000

OTHER PUBLICATIONS

U.S. patent application Ser. No. 09/333,054, filed Jun. 15, 1999.
U.S. patent application Ser. No. 09/865,496, filed May 29, 2001, pending.

* cited by examiner

*Primary Examiner*—Richemond Dorvil
*Assistant Examiner*—Donald L. Storm
(74) *Attorney, Agent, or Firm*—Oblon, Spivak, McClelland, Maier & Neustadt, P.C.

(57) ABSTRACT

A digital acoustic signal coding apparatus, a method of coding the digital acoustic signal, and a recording medium for recording a program of coding the digital acoustic signal are respectively realized. It is possible to provide the digital acoustic signal coding method and apparatus, in which, corresponding to the difference between the sampling frequencies of the input acoustic signal, short blocks can be suitably classified into groups without deteriorating sound quality and the suitability of using either long/short blocks can be judged. The coding apparatus is composed of a calculation medium for calculating the sensation entropy of an input acoustic signal per each of the respective short sensation blocks; a sensation entropy sum total calculation medium for obtaining a total sum in a frame of the sensation entropy; a comparison medium for comparing an absolute value of the difference between the respective total sums of the sensation entropy of successive two frames with a previously determined threshold value; and a long/short block judgment medium for judging whether a long block or short blocks should be used to convert a block of the input acoustic signal on the basis of the comparison result.

22 Claims, 30 Drawing Sheets

| SHORT BLOCKS (i) | PERCEPTUAL ENTROPY | |
|---|---|---|
| | FRAME f-1 | FRAME f |
| 0 | 90 | 50 |
| 1 | 160 | 40 |
| 2 | 240 | 30 |
| 3 | 310 | 30 |
| 4 | 280 | 60 |
| 5 | 170 | 90 |
| 6 | 80 | 450 |
| 7 | 60 | 280 |
| SUMMING-UP VALUE | 1390 | 1030 |

*FIG. 4*

FIG. 7

| SAMPLING FREQUENCY (KHz) | THRESHOLD VALUE (switch \| pe \| s) |
|---|---|
| 110.025 | 250 |
| 12 | 250 |
| 16 | 350 |
| 22.05 | 400 |
| 24 | 400 |
| 32 | 450 |
| 44.1 | 500 |
| 48 | 500 |

| SHORT BLOCKS (i) | PERCEPTUAL ENTROPIES ( PE (i) ) |
|---|---|
| 0 | 110 |
| 1 | 96 |
| 2 | 118 |
| 3 | 124 |
| 4 | 137 |
| 5 | 152 |
| 6 | 269 |
| 7 | 231 |

*FIG. 18*
*BACKGROUND ART*

FIG. 20

BACKGROUND ART

| SHORT BLOCKS (i) | PURE SOUND PROPERTY INDEX ( tb[i][sfb]) | | |
|---|---|---|---|
| | sfb=7 | sfb=8 | sfb=9 |
| 0 | 0.12 | 0.08 | 0.15 |
| 1 | 0.11 | 0.23 | 0.18 |
| 2 | 0.07 | 0.15 | 0.06 |
| 3 | 0.09 | 0.08 | 0.10 |
| 4 | 0.14 | 0.13 | 0.17 |
| 5 | 0.35 | 0.44 | 0.40 |
| 6 | 0.67 | 0.95 | 0.89 |
| 7 | 0.42 | 0.84 | 0.81 |

FIG. 21
BACKGROUND ART

| ORIGINAL SIGNAL VALUE | FIXED LENGTH CODE | HUFFMAN CODE | CODE NOT CAPABLE OF DECODING IN ONE MEANING |
|---|---|---|---|
| 0 | 000 | 110 | 110 |
| 1 | 001 | 1110 | 0000 |
| 2 | 010 | 00 | 00 |
| 3 | 011 | 01 | 01 |
| 4 | 100 | 10 | 10 |
| 5 | 101 | 1111 | 0001 |

QUANTIZATION HUFFMAN DODING

FIG. 23
BACKGROUND ART

| ORIGINAL SIGNAL VALUE | RESTORED VALUE | QUANTIZATION ERROR |
|---|---|---|
| 33 | 35 | 2 |
| 19 | 15 | 4 |
| 45 | 45 | 0 |
| 6 | 5 | 1 |
| 27 | 25 | 2 |
| 10 | 15 | 5 |

QUANTIZATION AND QUANTIZATION ERROR

BASIC FLOW OF ACOUSTIC SIGNAL CODING

FLOW OF CODING PROCESS AT MP3

FIG. 28

BACKGROUND ART (a) EXAMPLE OF NUMERICAL VALUE ROW 2 3 2 0 3 4 2 5 2 4
3 1 4 3 2 2 4 3 0 2

(b) CASE OF ALLOCATING FIXED-LENGTH CODE TO NUMERICAL VALUE ROW OF (a)

010 011 010 000 011 100 010 101 010 100
011 001 100 011 010 010 100 011 000 010

(b) CASE OF ALLOCATING HUFFMAN CODE TO NUMERICAL VALUE ROW OF (a)

00 01 00 110 01 10 00 1111 00 10
01 1110 10 01 00 00 10 01 110 00

METHOD, APPARATUS, AND MEDIUM OF DIGITAL ACOUSTIC SIGNAL CODING LONG/SHORT BLOCKS JUDGEMENT BY FRAME DIFFERENCE OF PERCEPTUAL ENTROPY

BACKGROUND OF THE INVENTION

1. Field of the Invention

The present invention relates to a digital acoustic signal coding apparatus, a method of coding a digital acoustic signal, and a recording medium for recording a program of coding the digital acoustic signal, in particular, the compression/coding of a digital acoustic signal utilized in, for instance, DVD recording/reproducing or in a digital broadcast, etc.

2. Discussion of the Background

The background arts are discussed with the main focus being on the compression of an acoustic signal.

At present, in the digital audio field, MP3 is a very popular coding technique MP3 is an abbreviation for an acoustic signal compression coding method called "MPEG-1 Audio Layer III". By employing MP3, digital audio such as data used for a CD, can be compressed to the extent of 1/11 without deteriorating the sound quality. Because of the convenience of compressing a large volume of acoustic data to a compact size that can be transmitted in a short time, MP3 is becoming popular for transmissions on the internet. At present, reproducing apparatuses suitable for use with MP3 are being introduced by several manufacturing companies, and some music distributing businesses are being operated using it.

On the other hand, even in the field of digital broadcasting, in accordance with the development of digitalization, the adoption of sound signal (acoustic signal) compressing technology has become common. At present, the method of MPEG-2 Audio BC is employed in CS broadcasting. Furthermore, the method of MPEG-2 Audio AAC is scheduled to be employed in BS and digital broadcasting of the wave on the ground, both to be started in 2000 or in subsequent years.

The above-mentioned matters relate to technology belonging to international standard of acoustic signal compression all called "MPEG Audio". In addition to MPEG Audio, for instance, acoustic signal compressing methods such as Dolby Digital (AC-3) and ATRAC, are used for DVD and MD.

As stated above, the use of compression/coding technology for digital audio has become more and more familiar day by day. The fundamental technology of acoustic signal compressing and the recent trends thereof are described hereinafter.

In acoustic signal compressing, acoustic signals are largely classified into "voice sound" and "musical sound" categories. Here, voice sound signifies the human voice and musical sound signifies not only the human voice, but also any general acoustic signal including music, life sound, natural sound, etc. The reason why sound has to be classified is that the object and utilized technology of the coding differs for each.

In voice sound coding, the human voice signal of low sampling rate of about 8–16 KHz is compressed for use with a low bit rate such as over a telephone circuit. On the other hand, in musical sound coding an acoustic signal of a high sampling rate of about 32–96 KHz is compressed keeping the sound quality as high as possible. In the former method, deterioration of sound quality cannot be avoided compared with the original sound, while, in the latter method, sound compression which fundamentally does not degrade the sound can be accomplished. Both of MP3 and AAC are included in the latter coding (musical sound coding).

The compressing of digital information is classified into two methods; reversible compression and non-reversible compression. In the former method, the original signal can be faithfully reproduced at the time of decoding. However, in the latter method, the distortion of the signal generally occurs. For performing acoustic signal compression coding, both of those methods are suitably combined. First, the reversible compression method is described.

Here, Huffman code employed also in MPEG Audio as the representative reversible compression method is described. Huffman coding is a method in which short code and long code are respectively allocated to a large frequency value and a small frequency value in accordance with an appearance frequency of the original signal value, and the signal is compressed such that the entire code value is made as small as possible. A code which is not of constant length is called a variable-length code, while a code of constant length for all values is called a fixed-length code. The original signal of acoustic compression is a fixed-length code represented by a number of bits of the respective constant digital sample values (16 bits in the case of CD).

FIG. 21 shows an example of such a fixed-length code and a Huffman code, and FIG. 28 shows an example of allocating such a code to an actual numerical value row utilizing the above-mentioned two codes. As shown in FIG. 21, in order to discriminate six sorts of different original signal value with the fixed-length code, it is necessary to allocate at least a 3 bit code to the respective values.

On the other hand, as is apparent from the numerical value row as shown in FIG. 28, if the appearance frequency of "2" is largest (e.g., 7 times) and the appearance frequencies of"1" and "5" are smallest (e.g., once), here, regarding the Huffman code shown in FIG. 21, a 2-bit code is allocated to "2" and a 4-bit code is allocated to "1" and "5". Regarding the other remaining values, a code of a length corresponding to the respective appearance frequencies is allocated thereto.

An important property of a Huffman code is that the original signal row can be decoded to have one meaning. In the example of FIG. 21, if the Huffman code row is "00110", the original signal row is "20". Since there is a one-meaning property for decoding, Huffman coding is reversible.

For reference, an example of a code not capable of decoding to have one meaning is also shown in FIG. 21. In this example, when the code row "000001" is received, it is impossible to distinguish which of the meanings of the original signal ("25", "13", or "223") was intended. Moreover, since a method of constructing a code capable of decoding with one meaning has been already shown, the description thereof is omitted here.

Now, in the case of allocating a fixed-length code, such as shown in FIG. 21, to a numerical value row, such as shown in (a) of FIG. 28, the code row becomes the one shown in (b) of FIG. 28, and the entire code amount turns out to be 3×20=60 bits. On the other hand, in the case of allocating a Huffman code, as also shown in FIG. 21, to a numerical value row shown in (a) of FIG. 28, the code row becomes one such as shown in (c) of FIG. 28, and the entire code amount turns out to be smaller (46 bits). In such a way, the entire code amount is further reduced in the case of allocating a Huffman code as compared with the case of a fixed-length code. Namely, when Huffman code is employed, the original signal value can be faithfully reproduced with a smaller code amount as compared with a fixed-length code. However, there is a limitation as to the compression factor, e.g., almost 77% as to the upper limit. Accordingly, it is impossible to expect a high compression factor, e.g., 1/11 in such a situation as mentioned above. Therefore, the technology of non-reversible compression is inevitably required. The basic quantization technology therefor is described hereinafter.

The use of quantization signifies the use of a method of classifying the level of the original signal value into plural steps and causing the values representing the respective levels to correspond to a restoring value (decoded) value. The above-mentioned method is described with reference to the example of FIG. 22.

Here, it is assumed that the original signal value is distributed as an integer between 0 and 60. When the value is converted to the fixed-length code as it is with a binary number, the respective value has to be expressed with bits. In this example, the original signal value is quantized to 6 levels and caused to correspond to the respective restored (decoded) values as shown in FIG. 22.

At the time of coding, the original signal value is divided by "10" and the decimal fraction part is removed (cut down). The above noted "10" is called the scale factor. The integer part of the quotient is limited to six sorts of values 0–5. The above method is called "quantization". As shown in FIG. 22, it is sufficient to express each of these values with a 3-bit fixed-length code, and, thereby, a compression factor of 50% can be realized. Furthermore, if the quantized value is converted to a Huffman code corresponding to the respective appearance frequencies, the compression factor can be further improved. FIG. 22 shows the case of allocating the Huffman code illustrated in FIG. 21 as an example.

At the side of the decoding, the quantized value is firstly restored (decoded) from the Huffman code. However, the method can be performed with one meaning as mentioned before. Thereafter, the quantized value is multiplied by the aforementioned scale factor "10" and added to "5=10/2". In such way, the value is restored (decoded). However, the original signal value does not coincide with the restored value in general, and therefore an error occurs. Such an error is called a "quantization error". A concrete example of such errors is shown in FIG. 23.

In such a way, in utilizing quantization, the original signal value cannot be completely restored. In that sense, although quantization is non-reversible, the compression factor thereof can be improved, owing to that non-reversible quantization. Moreover, the extent of compression corresponds to the number of levels of quantization. The less the number of levels, the more the acoustic signal can be compressed. However, the average quantization error is also increased.

The compression of the digital information has been generally described. Both Huffman code and quantization are basic technology widely used for the compression of an acoustic signal, a static-picture signal and a dynamic (moving)-picture signal.

Next, "masking effect" and quantization error are further described hereinafter. The aforementioned quantization error results in the deterioration of sound quality in acoustic signal compression. On the other hand, for the coding of the musical sound, the acoustic signal data is required to be compressed without deterioration of sound quality.

As to the method of determining the optimum number of levels of quantization, the property of human hearing called the "masking effect" is taken advantage of. This "masking effect" is a phenomenon in which a large volume sound erases (puts out or extinguishes) a surrounding small volume sound. The phenomenon has become widely familiar. To state it a little more precisely, a strong sound of a certain frequency erases a weak sound of another frequency neighboring (in the neighborhood of) the strong sound frequency.

The details of the above masking effect are further described hereinafter. The relationship between the frequency (KHz) represented by the horizontal coordinate (abscissa) and the sound intensity represented by the vertical coordinate (ordinate), and the sound intensity distribution of the input acoustic data on the both coordinates are described. Here, for instance, the input sounds (b) and (c) are masked or effectively erased by the further strong sound (a) such that both of (b) and (c) cannot be heard. This is the "masking effect." The masking threshold value signifies a boundary (border line) between audible sound and inaudible sound.

Furthermore, the human ear has an inherent characteristic having an absolute threshold value (or minimum audible threshold value) that represents the minimum sound (intensity) which a human can hear in a quiet environment. The human ear has its sharpest (most sharp) sensitivity for sound in the neighborhood of 2 KHz~5 KHz. The human ear gradually becomes unable to hear sound of frequencies lower than 2 KHz or higher than 5 KHz.

Here, the masking threshold value changes in accordance with the input acoustic signal data. However, it is important to note that the absolute threshold value does not change at all.

In conclusion, among all sound, only sound of an intensity stronger than the masking threshold value and the absolute threshold value is in the audible area. As a result, even though the information content of sound in the other area (in the inaudible area) is removed, the human ear can hear the sound in the same state as that of the initial input sound.

In acoustic signal compression, utilizing such property of using this masking effect, only input acoustic signal data having a higher level than the masking threshold value, that is, data in the gray area, is coded, and thereby, the amount of data is greatly reduced.

In actuality, both of the above noted threshold values correspond to the tolerable upper limit of the aforementioned quantization error. Namely, when input acoustic signal data is quantized, if the quantization error does not exceed the larger one of both of the threshold values, the human ear does not sense the deterioration of audible sound quality. In the area of a small threshold value, if the number of quantization levels is not made large, the deterioration of sound quality may become prominent. On the other hand, in the area of a large threshold value, it may be allowable to reduce the number of quantization levels.

Next, the method of converting input acoustic signal data is described hereinafter. Input acoustic data is generally represented (expressed) as a row of digital sample value in the time direction. However, the aforementioned masking effect cannot be suitably applied to such a row as it is. For this reason, it is necessary to convert the row of the above-mentioned digital sample value so that it can be easily processed.

There are several methods of converting the input acoustic signal data. One of them is a method of combining into a block the data row in the time area (domain) per constant samples number and converting the data row to a data row in the frequency area (domain) per same constant samples number. FIG. 24 shows the waveforms of the acoustic signals before and after the above conversion. More particularly, FIG. 24A shows the waveform of the acoustic signal data row of 1,024 samples in the time area, and FIG. 24B shows the data row converted to the waveform of the acoustic signal data row of 1,024 samples in the frequency area.

Generally, when an acoustic signal is converted from the time area or domain to the frequency area or domain, a deviation of the sound amount (energy) occurs in a certain frequency area. For instance, as shown in FIGS. 24A and 24B, although the signal value is uniformly distributed in the time area, the energy of the acoustic signal in the frequency area is deviated to the low frequency side. At the time of coding, the bit is distributed, putting emphasis, onto the part where the energy is concentrated. As a result, the compression efficiency can be further improved.

Moreover, regarding the conversion of the time area to the frequency area, there exist several methods; e.g., DFT (Digital Fourier Transform), and DCT (Digital Cosine Transform), etc. However, for the purpose of compressing image (picture) data and acoustic data, DCT and its modification MDCT (Modified Digital Cosine Transform) are most frequently utilized.

Regarding the conversion of input acoustic signal data, in addition to the above-mentioned methods, there exists a method of subband division. In the subband division method, the band of the input waveform is divided into plural frequency bands, and the respective divided waveform is kept in the time area. This is different from the above time area to frequency area conversion method.

Moreover, if input data composed of samples of the number m are divided into sample bands of the number n, the samples number of the respective subbands becomes m/n. FIG. 25 shows a simple example of dividing the input waveform into two subbands.

Next, the flow of the basic process of acoustic signal compression coding is described. The most basic technology utilized for acoustic signal coding has been thoroughly described heretofore. Here, the flow of the basic process of acoustic signal compression coding obtained from the combination of the above-mentioned processes is summarized relative to FIG. 26 which shows the flow.

At first, input acoustic signal data is converted from the time area to data in the frequency area or subband division is practiced as to this input acoustic signal data. Next, the respective sample values after conversion are quantized. At this time, the masking threshold value of the acoustic signal data are calculated in parallel, and the upper limit of the quantization error in the respective frequencies is previously obtained from the combination of the above calculated threshold value with the absolute threshold value. The above-mentioned step is performed by the audio psychology model part shown in FIG. 26. Quantization is performed such that the error does not exceed the upper limit thereof. Finally, the Huffman code is allocated in accordance with the appearance frequency of the respective quantization, and then final coding data are created.

Furthermore, the above mentioned step shows the outline of the most basic process of acoustic signal compression coding. In a practical coding method such as MP3, AAC, etc., various processes in addition to the above can be devised, and thereby an improvement of the compression factor can be obtained.

Here, the coding process of MP3 is described, putting focus on the difference between MP3 and AAC. The flow of the basic process is:

(1)conversion to the Frequency Area,

(1) Quantization and

(1) Huffman Coding.

Next, subband division and MDCT are described. FIG. 27 shows the flow of the coding process for MP3 putting focus on subband division and the MDCT process. The big difference between MP3 and AAC is that the subband division process is done before MDCT in MP3. As noted above, subband division signifies the division of input data into plural frequency bands. This data is arranged on a time axis in the respective division areas.

In MP3, the input data is divided into 32 bands, and MDCT is practiced per each of the respective divided bands. As in the case of AAC, two sorts of the window functions of LONG/SHORT type can be used. The length of a LONG type is 36 samples, while the length of a SHORT type is 12 samples. However, contrary to AAC, MP3 include both of the LONG/SHORT type. In FIG. 27, high frequency is used for the SHORT type and low frequency is used for the LONG type. Needless to mention, it may be allowable to use the all frequency for the SHORT type or for the LONG type. Moreover, in AAC, the length of the LONG type window is 2,048 samples. In MP3, the conversion calculation of the above-mentioned 36 samples to the length before the subband division is done, the calculated value becomes equal to 36×32=1,152 samples.

In high-quality compression/coding of a digital acoustic signal, the psychological property of human hearing has been utilized as noted above. According to such property, a small sound is masked by a large sound. As a result, the small sound cannot be heard. Namely, when a large sound of a frequency is emitted, the small sound of a frequency near the above noted large sound frequency cannot be heard by the human ear. Here, the limited (critical) sound intensity which cannot be heard due to such masking is called "masking threshold value".

On the other hand, the human ear has the property that sensitivity to sound having a frequency near 4 KHz is highest, and the more distant any sound frequency is from 4 KHz, the lower the sensitivity of the ear gradually becomes. Such property is expressed as the critical sensitivity capable of sensing the sound in a quiet situation, and the sensitivity is called "absolute audible threshold value".

The above-mentioned matters are further described hereinafter referring to FIG. 9 illustrating the intensity distribution of an acoustic signal. In FIG. 9, a wide solid line (A), a dotted line (B), and a fine solid line (C), respectively, represent the intensity distribution of an acoustic signal, a masking threshold value for the acoustic signal, and an absolute audible threshold value. As shown in FIG. 9, the human ear can sense only the sound of the intensity larger (stronger) than the masking threshold value and the absolute audible threshold value for the acoustic signal. Consequently, even though only the information of the portion larger than the masking threshold value and the absolute audible threshold value for the acoustic signal are taken out of the intensity distribution of the acoustic signal, the information is sensed by the human ear to the same extent as the initial acoustic signal.

In the coding of the acoustic signal, the above matter is equivalent to coding only the portions shown by the slanted lines in FIG. 9. However, the entire area of the acoustic signal is divided into plural small areas and the coding bit allocation is performed here in units of divided band width (D). The transverse width of the respective areas shown by the slanted lines corresponds to the divided band width.

In the respective divided band widths, sound of intensity not larger than that of the lower limit of the slanted area cannot be heard by the human ear. Therefore, if the intensity error of the original sound and the coded/decoded sound does not exceed the lower limit thereof, the difference between both of them cannot be sensed. In that sense, the lower-limit intensity is called "tolerable error intensity". When the acoustic signal is quantized and compressed, if the quantization error intensity of the coded/decoded sound for the original sound is quantized so as to make it not larger than the tolerable error intensity, the acoustic signal can be compressed without damaging the quality of the original sound. Therefore, allocation of coded bits only to the slanted-line area shown in FIG. 9 is equivalent to performing quantization such that the quantization error intensity in the respective divided band widths is just equal to the tolerable error intensity.

As to the method of coding the acoustic signal, there exist MPEG (Moving Picture Experts Group) Audio and Dolby Digital, etc. All of them utilize the property as described here. Among those methods, the one having the highest coding efficiency at present is that of MPEG-2 Audio AAC (Advanced Audio Coding) standardized in ISO/IEC13818-7.

FIG. 10 is a block diagram illustrating the fundamental structure of such AAC coding. In FIG. 10, an auditory sense psychology model section 101 calculates the tolerable error intensity per each of the respective band widths of the input acoustic signal separated into blocks along the time axis. On the other hand, conversion to the frequency area with MDCT (Modified Discrete Cosine Transform) is performed in a gain control 102 and a filter bank 103 for the input signal also separated into blocks. A TNS (Temporal Noise Shaping) unit 104 and an estimation unit 106 perform the estimation coding. An intensity/coupling unit 105 and an MS Stereo (Middle Side Stereo) (hereinafter, called abbreviated "M/S") unit 107 perform a stereo correlation coding process. Thereafter, a normalizing coefficient 108 is determined. The acoustic signal is quantized in a quantizing unit 109 on the basis of the normalizing coefficient 108. The normalizing coefficient corresponds to the tolerable error intensity shown in FIG. 9, and the coefficient is determined per each of the respective divided band widths. After the quantization, the Huffman code is respectively given to the normalizing coefficient and the quantizing value in a noise coding unit 110 on the basis of the predetermined Huffman code list. Finally, a code bit stream is formed in a multiplexer 111.

Now, MDCT in the aforementioned filter bank 103 is the one for overlapping the conversion areas by 50% along the time axis as shown in FIG. 11 and at the same time practicing DCT (Discrete Cosine Transform). Owing to such functions, the occurrence of distortion on the bordering part (boundary) of the respective conversion areas can be suppressed. In AAC (Advance Audio Coding), either one of the long conversion area (long block) of 2048 samples or the eight short conversion areas (short blocks) of respective 256 samples is applied for the input acoustic signal block. Consequently, the number of MDCT coefficients is 1024 for a long block and 128 for short blocks. In the case of employing the short blocks, eight blocks are always applied successively and thereby the number of MDCT coefficients turns out to be same as the MDCT coefficients number at the time of employing a long block.

Generally, a long block is employed in the regular part of small variation in the signal waveform as shown in FIG. 12, while short blocks are employed in the attack part of violent (sharp) variation in the signal waveform. It is important to employ the long and short blocks in these different ways. If the long block is applied to the signal as shown in FIG. 13, a noise called "pre-echo" occurs before the essential attack. On the contrary, if the short blocks are applied to the signal as shown in FIG. 12, adequate bit allocation cannot be performed due to insufficient resolution in the frequency area. As a result, a coding efficiency is lowered and noise occurs. The matter is prominent, in particular, for sound of low frequency.

As to the short blocks, there further arises a problem of dividing (separating) these into groups. This dividing into groups signifies that the above-mentioned eight short blocks are put together into groups per each of the successive blocks of the same normalizing coefficient. The effect of reducing the amount of information can be raised by making common the normalizing coefficient in the group. To state this concretely, when the Huffman code is allocated to the normalizing coefficient in the noiseless coding (section) 110 shown in FIG. 10, the code is allocated not per each of the respective short blocks unit but per the group unit. FIG. 14 illustrates an example of dividing it into groups. Here, the number of the groups is three. The number of the blocks in the top group (O-th group) is five, the number of the blocks in the next group (1st group) is 1, and the number of the blocks in the last group (2nd group) is two. If the dividing into groups is not performed suitably, that results in an increase of the code amount (number) and the lowering of the sound quality. If the dividing number of the groups is too large, the normalizing coefficient which should be able to be made common essentially turns out to be coded duplicately (doubly). As a result, coding efficiency is lowered. On the other hand, if the (dividing) number of the groups is too small, since the quantization is performed with the common normalization coefficient in spite of the violent (sharp) variation of the acoustic signal, sound quality is lowered. Moreover, in ISO/IEC13818-7, although there exists a prescription of the code syntax (syntactics) with regard to the division into groups, the concrete standard and method of the division into group have not been taken into consideration.

As mentioned below, with respect to coding, the long block and the short blocks have to be suitably applied for the input acoustic signal block with the above noted distinction therebetween. The auditory sense psychology model section 101 shown in FIG. 10 performs the long/short judgment. An example of the long/short judgment method for the respective blocks to be noticed in the auditory sense psychology model section 101 is shown in the ISO/IEC 13818-7. The outline of the judging process is explained hereinafter.

Step 1: Reconstruction of the Acoustic Signal 1024 samples for a long block are newly read (included) and the signal system (series) of 2048 samples in addition to 1024 samples previously included in the new block is reconstructed, while 128 samples for the short blocks are newly read (included) and the signal system (series) of 256 samples in addition to 128 samples previously included in the new block is reconstructed.

Step 2: Multiplication of Hann Window and FFT

The acoustic signal of 2048 samples (256 samples) constructed in Step 1 is multiplied by the Hann window (Hanning). Furthermore, FFT (Fast Fourier Transform) is practiced and thereby 1024 (128) FFT coefficients are calculated.

Step 3: Calculation of the Estimation Value of the FFT Coefficient

A real number part and an imaginary number part of the respective FFT coefficients in the block being processed is estimated from the real number part and the imaginary number part of the FFT coefficients of (per) preceding two blocks, and then the estimated values of 1024 (128) are respectively calculated.

Step 4: Calculation of the Non-Estimation Possibility Value

Respective non-estimation possibility values are calculated from the estimation values of the real number and the imaginary number of the respective FFT coefficients calculated in Step 2 and those of the respective FFT coefficients calculated in Step 3. Here, the non-estimation possibility value takes a value between 0 and 1. The nearer to 0 the value is, the lower is the pure-sound property of the acoustic signal, while the nearer to 1 the value is , the higher is the pure-sound property of the acoustic signal. In other words, the lower value fact shows that the pure-sound property is low and a noise property is high.

Step 5: Calculation of the Acoustic Signal Intensity and the Non-Estimation Possibility Value in the Respective Divided Band Width Here, the divided band width corresponds to the one shown in FIG. 9. The intensity of the acoustic signal is calculated on the basis of the respective FFT coefficients calculated in Step 2 per each respective divided band width. Furthermore, the non-estimation possibility value calculated in Step 4 is weighted with the intensity, and the non-estimation possibility value is calculated per each respective divided band width.

Step 6: Folding-in (Convolving) of the Intensity multiplied by the Expanse (Spreading) Function and the Non-Estimation Possibility Value The effects due to acustic signal intensity and a non-estimation possibility value of the other divided band withd in the respective divided band widths is obatained by use of an expanse (spreading) function. The effects thus obatained are respectively folded in (convoled) and thereby normalized.

Step 7: Calculation of the Pure Sound Property Index

In each respective divided band width b, a pure sound property index tb(b) C=−0.299−0.43 log.(cb(b)) is calculated on the basis of the folded-in (convolved) non-estimation possibility value (cb(b)) calculated in Step 6. Furthermore, the pure-sound property index is limited within the area between 0 and 1. Here, the above matter shows that the nearer to 1 the index is, the higher is the pure sound property of the acoustic signal, while the nearer to 0 the index is, the higher is the noise property of the acoustic signal.

Step 8: Calculation of the S/N Ratio (Signal-to-Noise Ratio)

The S/N ratio (signal-to-noise ratio) is calculated on the basis of the pure sound property index calculated in Step 7, in the respective divided band widths. Here, the property that the masking effect of the noise component is larger than that of the pure sound component is generally utilized.

Step 9: Calculation of the Intensity Ratio

The ratio of the folded-in acoustic signal intensity and the masking threshold value is calculated on the basis of the S/N ratio calculated in Step 8, in the respective divided band widths.

Step 10: Calculation of the Tolerable Error Intensity (Masking Threshold Value)

The masking threshold value is calculated on the basis of the folded-in acoustic signal intensity calculated in Step 6 and the ratio of the acoustic signal intensity calculated in Step 9 and the masking threshold value, in the respective divided band widths.

Step 11: Adjustment of the Pre-Echo and Consideration of the Absolute Audible (−Frequency) Threshold Value Pre-echo adjustment is performed for the masking threshold value calculated in Step 10 by use of the tolerable error intensity of the preceding block, in the respective divided band widths. Furthermore, the larger value of the adjusted value and the absolute audio (−frequency) threshold value is employed as the tolerable error intensity of the present block.

Step 12: Calculation of the Perceptual Entropy

The perceptual entropy PE as defined in equation (1) below is respectively calculated for the long block and for the short blocks.

[Equation (1)]

$$\begin{aligned} PE &= -\sum_b w(b)\log_{10}\frac{nb(b)}{e(b)+1} \\ &= -\sum_b w(b)[\log_{10}nb(b) - \log_{10}\{e(b)+1\}] \\ &= \sum_b w(b)[\log_{10}\{e(b)+1\} - \log_{10}nb(b)] \end{aligned}$$

In equation (1), w(b) represents the width of the divided band width b, nb(b) represents the tolerable error intensity in the divided band width b calculated in Step 11, and e(b) represents the intensity of the acoustic signal in the divided band width b calculated in Step 5. Here, PE is thought to correspond to the total of the square measures of the bit allocating areas (slanted-lines areas) as shown in FIG. 9.

Step 13: Judgment of the Long/Short blocks

Regarding the judgment of the long/short blocks, refer to the long/short blocks judging operation flow shown in FIG. 15.

When the value of PE (Step S10) for the long block calculated in Step 12 is larger than a predetermined constant (switch_pe), the processed block is judged to be one of the short blocks (Steps S11 and S12). When the same value of PE is smaller than the predetermined constant, the processed block is judged to be a long block (Steps S11 and S13). Here, the predetermined constant (switch_pe) is a value determined in dependence to the application.

The method mentioned heretofore is the long/short judgment method described in ISO/IEC 13818-7. However, in the above long/short block judgment method, a suitable judgment is not always made. Namely, the part that should be judged to be short is judged to be long (or vice versa) and thereby the sound quality is deteriorated on some occasions.

On the other hand, in the published specification of Japanese Laid-open Patent Publication No. 9-232964, a transient state detecting circuit 2 is constructed such that the input signal is taken in per each of the respective predetermined sections and the square sums thereof are respectively obtained, and the transient state of the above-mentioned signal in accordance with the variation rate (degree) over the at least two or more sections of the signal squarely summed per each of the respective sections. In such structure, it is possible to detect the transient state, that is, the part in which the long/short varies only by performing the calculation of the square sum of the input signal on the time axis without performing any perpendicular (rectangular) conversion processing and filter processing. According to such a method, since the perceptual entropy is not considered by use of only the square sum of the input signal, the judgment coinciding with the audio property cannot always made. Consequently, there is a possibility that the sound quality will deteriorate.

In such a situation, the input acoustic signal block is divided (classified) into several groups such that the difference between the maximum value and the minimum value of the perceptual entropy regarding the respective short blocks in the same group. As the result, there exists a method that, when the groups number is 1, or when the groups number is 1 and the other condition is satisfied, the input acoustic signal block is converted to the frequency area with one long block, and in the other case, the signal block is converted to the frequency area with plural short blocks. The above-mentioned block is further concretely described hereinafter, referring to FIG. 16 illustrating the operation flow thereof. Furthermore, as an example of the input acoustic signal, the acoustic data shown in FIG. 17 are employed and the through-out numbers are attached corresponding to the respective successive eight short blocks in FIG. 17.

At first, the inputted acoustic signal is divided into eight successive short blocks. And then, the perceptual entropies of the eight short blocks are respectively calculated. The calculated values are assumed to be PE(i) ($0 \leqq i \leqq 7$) in order (Step S20). The calculation can be realized by performing, for the respective short blocks, the method explained in the Steps 1 through 12 of the long/short judgment method for the respective processed blocks in the above-mentioned ISO/IEC 13818-7. Next, the initializing operation is performed on the condition of group_len [0]=1, group_len [gnum]=0($0 \leqq$ gnum $\leqq 7$(Step S21).

Here, gnum represents the through-out number of a certain group in the overall groups, and group_len [gnum] represents the number of short blocks included in the gnum-th group, and then, the initializing operation is respectively performed on the condition of gnum=0, min=PE(0), and max=PE(0) (Step S20). In the above condition, min and max respectively represent the minimum value and the maximum value of PE(i). In FIG. 18, min and max are respectively equal to 110and 110. (min=110, max=110). Furthermore, the index i is initialized with i=1 (Step S23). The index corresponds to the through-out number of the short blocks.

Next, min or max is renewed in accordance with PE(i). Namely, if PE(i) is smaller than min, min is equal to PE(i), or if PE(i) is larger than max, max is equal to PE(i). (step S24)

PE(i)<min . . . min=PE(i)

PE(i) >max . . . max=PE(i)

In the example shown in FIG. 18, if PE(i)>max, max=PE(i). (step S24)

And the classification of the group is judged. (step S25) Namely, the obtained value (max−min) is compared with a predetermined threshold value th. When the obtained value (max−min) is equal to or larger than the value th, the step advances to the Step S26 in order to perform the group classification between the short blocks (i−1) and i. When the value (max−min) is smaller than the value th, the short blocks (i−1) and i are judged to be included in the same group, and the step advances to the Step S27. In this example, the value th is equal to 50 (th=50). Namely, the group classification is performed such that the difference between the maximum value and the minimum value of the respective short blocks PE(i) included in the same group becomes smaller than 50.

When i=1, since max−min=110−96=14<50=th, the short blocks 0 and 1 are judge to be included in the same group, and the step advances to the Step S27. Here, since gnum=0, the short blocks 0 and 1 advance to the step S27. Moreover, since gnum=0 here, the short blocks 0 and 1 are included in the 0-th group, and increments, by one, the value of group_len [gnum] (Step S28). This signifies to increase, by one, the number of the short blocks included in the gnum-th group. In the example, since the initialization is performed in the state of gnum=0 and group_len [0]=1, the state becomes group_len [0]=2 in the step S27. That corresponds to the fact that the two blocks in the blocks 0 and I are set as short blocks included in the 0-th group.

Next, the index i is incremented by 1 (Step S28). When i is smaller than 7, the step returns to the Step S24 (Step S29). In this example, since i is equal to 2 (<7), i=2<7, the step returns to the Step S24.

Thereafter, the same operation as described heretofore follows until i=4. When i is equal to 4, since the values of min and max are respectively equal to 96 and 137 in Step S24 of FIG. 16, as shown in FIG. 18, the judgment; max−min=41<50=th, is performed in Step S25, and the step directly advances from the Step S25 to the Step S27. In the Step 27, group_len [0] becomes equal to 5.

group_len [0]=5

Namely, this corresponds to the fact that the five blocks; 0, 1, 2, 3, and 4 are set as short blocks included in the O-th group. And then, when the step returns again to the Step S24 via the Step S29 after i becomes equal to 5 in Step S28, PE(5) becomes equal to 152 at this time and therefore the values of min and max respectively become equal to 96 and 152. And then, since the judgment; max−min=56>50=th is performed in Step S25, the step advances to Step S26. This signifies that the group classification is performed between the short blocks 4 and 5. The value of gnum is incremented by 1 in the Step S26, and the values of min and max are respectively replaced by the newest PE(i). Here, the respective values of gnum, min, and max are 1,152, and 152. The equation gnum=1 corresponds to the fact that the group of the short blocks 5 included therein is the first group.

Next, the value of group_len [1] is incremented by 1 in the Step S27. Since the value of group_len [1 ] has been initialized to 0 (zero) at the Step S21, the value of group_len [1] becomes equal to 1 again in such state. That corresponds to the fact that one block in the block 5 as the short blocks included in the first group.

In the similar way hereinafter, i becomes equal to 6 in the Step S28 of FIG. 16. When the step returns from the Step S29 to the Step S24, since the value of PE(6) becomes equal to 269, next time, as shown in FIG. 18, the values of min and max respectively become equal to 152 and 269. At this time, the judgment of max−min=117>50 is performed at the Step S25, and the step advances to the Step S26. Namely, group classification is performed even between the short blocks 5 and 6. And then, gnum=2, min=269, and max=269 in the Step S26, and group_len [2]=1 in the Step S27, and i=7 in the Step S28. Thereafter, since PE(7)=231 in the Step S24 in the same way as in the past, min=231 and max=269, and the judgment of max−min=38<50 is performed in the Step S25, and the step advance to the Step S27. Namely, both of the short blocks 6 and 7 are included in the second group. In correspondence with the above-mentioned, the value of group_len [2]=2 in the Step S27. Now, when i becomes equal to 8 (i=8) in the next Step S28, the step advances to Step S30 in accordance with the judgment of Step S29. At this time point, the group classification has been completed for all of the eight short blocks.

In this example, the following holds true:

Gnum=2;

Group_len [0]=5;

Group_len [1]=1; and

Group_len [2]=2.

Namely, as a result, the number of the groups is 5, and the numbers of the short blocks included in the respective groups are 5, 1, and 2, for the O-th group, the first group, and the second group, respectively. The above result is same as the example of group classification shown in FIG. 14.

However, there exists a case of not being able to perform suitable judgment of long/short even in this method mentioned above. For instance, there is the case of coding acoustic data including a component of a high pure sound property in a low frequency component (area). The conversion performed by use of the short blocks results in an increase of resolution in the time area, while the resolution in the frequency area is lowered (decreased). On the other hand, the human ear has the masking property of a high resolution in a low frequency area. In particular, only a very narrow frequency band width is masked for a acoustic data of a high pure sound property.

On the contrary, if the acoustic data including the component of a high pure sound property in a low frequency component (area) is converted with the short blocks, the energy of the original (initial) acoustic data is dispersed into the circumferential (peripheral) frequency band width due to the insufficient resolution in the frequency band width caused by the short blocks, and the energy further spreads out over the width of the masking in the low audio frequency which can be heard by the human ear. As the result, the deterioration of the sound quality will be heard. The above-mentioned matter signifies that it is insufficient to simply perform the judgment of long/short only on the basis of perceptual entropy with respect to the short blocks and further, that it is necessary to take into consideration the combination of the pure sound property of the acoustic data and the frequency dependence of the masking property.

In this respect, the input acoustic signal frame is divided into plural short blocks, and it is judged whether the pure sound property index of the acoustic component included in a predetermined one or plural divided band widths (areas) is larger than the threshold value. In case that there exists at least one short block larger than the aforementioned predetermined threshold value in all of the predetermined one or plural divided band widths (areas), it is judged that the input acoustic signal frame is converted to the frequency area with one long block. FIG. 19 illustrates a concrete example of realizing such a method.

FIG. 19 is a flow chart illustrating the operation of a digital acoustic signal coding apparatus. The acoustic data of FIG. 17 are employed as an example of the input acoustic signal. In FIG. 17, the through-out numbers are attached in correspondence with the respective eight successive short blocks.

At first, in connection with the successive eight short blocks i ($0 \leqq i \leqq 7$), the inputted acoustic signal respectively calculates the values of the pure sound property index in the respective divided band widths sfb. Those calculated values are assumed to be tb[i][sfb] (Step S40). Here, as shown in FIG. 17, sfb is the through-out number for recognizing the respective divided band width. The calculation of the pure sound property index is performed by the method explained in the Step 7 in the long/short judgment step for the respective processed blocks in the aforementioned ISO/IEC 13818-7. Next, the initializing operation of tonal-flag=0 is done (Step S41). Furthermore, the through-out number i of the short blocks is initialized as i=0 (Step S42). And then, with respect to the short blocks i, whether the respective pure sound property indices are larger than the predetermined threshold value for the respective divided band widths is searched in the predetermined one or plural divided areas (Step S43). In the example shown in FIG. 19, the search is done with respect to the divided areas; sfb=7, 8, and 9, and the respective pure sound property indices; th7, th8, and th9.

Now, in this example, assume that the values of the pure sound property indices at sfb=7, 8, and 9 are the ones as shown in FIG. 20 with respect to the respective short blocks i, and further assume that the respective threshold values are fixed as follows:

th7=0.6, th8 32 0.9, and th9=0.8.

At the first i=0, the following relationships are brought into existence:

tb[0][7]=0.12<0.6=th7, tb[0][8]=0.08<0.9=th8, and tb[0][9]=0.15<0.8=th9.

Consequently, the judgment at Step S43 becomes "no", and the step advances to the next Step S45. And then, the value i is incremented by 1 and the value i becomes equal to 1 (i=1), and the step returns again to Step S43 via the judgment of Step S46.

Thereafter, the same operation as the aforementioned operation continues until i=5. After i becomes equal to 6 (i=6) (Step S45), the step returns again to Step S43 via Step S46. And then, since the following relationships are brought into existence:

tb[6][7]=0.67>0.6=th7;

tb[6][8]=0.95>0.9=th8; and tb[6][9]=0.89>0.8=th9,

The judgment in Step S43 becomes "Yes", and step advances to Step S44. At this time, the value of tonal_flag becomes equal to 1 (Step S44).

Tonal_flag=1

Next, i becomes equal to 7 (i=7) (Step S45), and the step returns again to Step S43 via Step S43. At the time of i=7, since the following relationships are brought into existence:

tb[7][7]=0.42<0.6=th7;

tb[7][8]=0.84<0.9=th8; and tb[7][9]=0.81<0.8=th9,

The judgment in the Step S43 becomes "no", and the step advances to Step S45. On the other hand, the value of tonal_flag is kept at 1 and does not change at all. And then, after i becomes equal to 8 (i=8) (Step S45), the step advances, at this time, to Step S47 via the judgment of Step S46, and then, the value of tonal_flag (Step S47). In this example, since tonal_flag=1, the judgment becomes "Yes" and the step advances to Step S48. Consequently, it is judged that the inputted acoustic block is MDCT-converted by one long block.

SUMMARY OF THE INVENTION

The background arts regarding the digital acoustic signal coding apparatus, the method of coding the digital acoustic signal, and the recording medium for recording the program of coding the digital acoustic signal have been described above.

However, according to such background arts, for instance, and as disclosed in the background-art documents, e.g., the published specification of Japanese Laid-open Patent Publication No. 9-232964 and the other documents relating to MPEG-2 Audio AAC (Advanced Audio Coding) standardized in ISO/IEC 13818-7, MDCT (Modified Discrete Cosine Transform), and the M/S (MS stereo-Middle Side Stereo), etc., there exists no advantageous functional effect for improving the above-mentioned apparatus, method, and recording medium. The present invention has been made in view of the above-mentioned problems and other problems in order to solve the above defects and troublesome matters described relative to the background arts. The present invention, thus, solves the various problems of the background arts mentioned heretofore. The present invention provides an improved digital acoustic signal coding apparatus and method and the improved recording medium for recording the program of coding the digital acoustic signal.

More specifically, the object of the present invention is to solve the problems as mentioned heretofore. Even in the background-art methods mentioned above, the judgment of long/short is not performed suitably on all occasions. Thus, in spite of the conversion by use of the short blocks(s) is essentially the usual method, the result of the above-mentioned background-art group classification becomes 1 group, short blocks are incorrectly judged to be the long block on some occasions.

Furthermore, in FIG. 9, since the smaller (lower) the sampling frequency of the input acoustic signal becomes in the area of the frequency equal to or higher than 4 kHz, the lower becomes the extent of the contribution owing to the absolute audible threshold value, the (total) square measure of the bit allocating areas (slanted-line area in FIG. 9) relatively increases. As a result, the value of the perceptual entropy (PE) calculated in the Step S12 in the long/short blocks judgment method described in the above-mentioned ISO/IEC 13818-7 also becomes gradually large.

On the other hand, when the threshold value with respect to the difference between the sums (sum values) of perceptual entropies of the respective short blocks takes a common value regardless of the sampling frequency, there arises a problem to be solved that, even though the long/short judgment can be suitably performed at a (certain) sampling frequency, the same judgment cannot be suitably performed at other sampling frequencies.

The primary object of the present invention is to solve the above-mentioned problems. According to the invention, the short blocks can be suitably classified into groups without deteriorating sound quality, taking a countermeasure for the difference between the sampling frequencies of the input acoustic signal, and furthermore, the difference of long/short can be correctly judged (discriminated). Another object of the present invention is to provide a digital acoustic signal apparatus, a method of coding the digital acoustic signal, and a recording medium for recording thereon the digital acoustic signal coding program.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 4 is a diagram (list) for explaining the relationship between perceptual entropies in the two frames which are successive in the elapsing time for the respective short blocks;

FIG. 7 is a diagram (list) for explaining an example of a threshold value per each of the sampling frequencies;

FIG. 18 is a diagram (list) showing the relationship between the short blocks and the perceptual entropy;

FIG. 20 is an explanatory diagram for explaining the relationship between the short blocks and the pure sound property index;

FIG. 21 is an explanatory diagram for explaining the relationship between an original signal value, a fixed length code, a Huffman code, and a code not capable of decoding;

FIG. 23 is an explanatory diagram for explaining the concrete numerical example of quantization error;

FIGS. 24A and 24B are explanatory waveform diagrams for explaining the conversion of waveform in the time area (domain) to a waveform in the frequency area (domain), wherein FIG. 24A shows the relationship between sound amplitude and time and FIG. 24B shows the relationship between sound volume and frequency;

FIG. 28 shows an example of a numerical value row and two cases of respectively allocating fixed-length code and a Huffman code to the numerical value row.

DETAILED DESCRIPTION OF THE PREFERRED EMBODIMENTS

Figure 1:
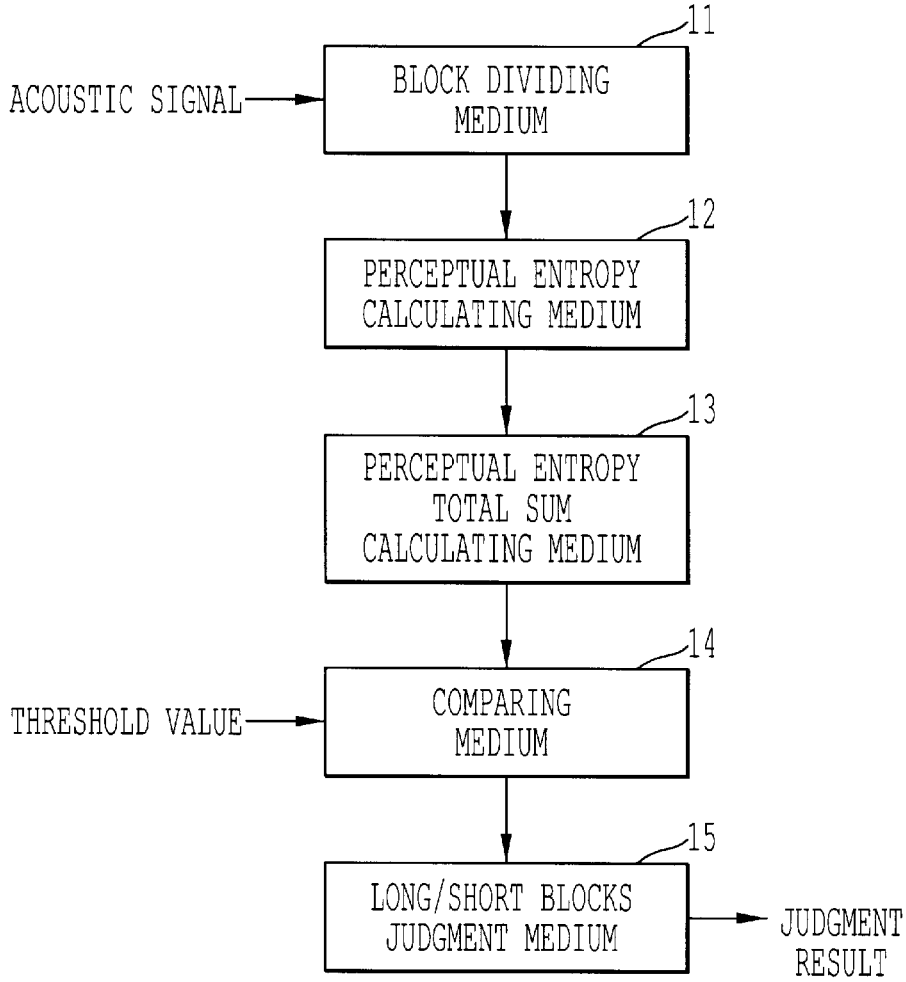
FIG. 1 is a block diagram illustrating the structure of a digital acoustic signal coding apparatus according to the present invention.

In describing the preferred embodiment of the present invention illustrated in the drawings, specific terminology is employed for the sake of clarity. However, the present invention is not intended to be limited to the specific terminology so selected and it is to be understood that each specific element includes all technical equivalents which operate in a similar manner.

Referring now to the drawings; wherein like reference numerals designate identical or corresponding parts throughout the several views (diagrams), and more particularly to FIGS., 1 through 8 thereof, there are illustrated an improved digital acoustic signal coding apparatus, an improved method of coding a digital acoustic signal, and an improved medium for recording a program for coding a digital acoustic signal.

To state in more detail, in order to solve the aforementioned problems, the digital acoustic signal coding apparatus of the present invention is composed of a perceptual entropy calculation medium for calculating the perceptual entropy of an input acoustic signal calculated per each of the respective short conversion blocks; a perceptual entropy sum total calculating medium for obtaining the sum total in the frame of the perceptual entropy calculated by the perceptual entropy calculation medium; a comparison medium for comparing the absolute value of the difference between the respective sum totals in the frame of the perceptual entropy of the two frames being successive in relation to the elapsing time with a previously determined threshold value; and a long/short blocks judgment medium for judging whether long block or short blocks should be used to convert the block of the input acoustic signal on the basis of the comparison result obtained by the comparison medium.

Furthermore, in the digital acoustic signal coding apparatus of the present invention, when the absolute value is larger than the threshold value as the comparison result obtained by the comparison medium, the long/short blocks judgment medium judges that the later frame among the two frames successive in elapsed time is to be converted by using short blocks; and, when the absolute value is smaller than the threshold value, the long/short blocks judgment medium judges that the later frame among the two frames is to be converted by using long block.

Consequently, it is possible to provide digital acoustic signal coding apparatus capable of performing block conversion better reflecting (effectively utilizing) the property of the input acoustic signal.

Furthermore, the other digital acoustic signal coding apparatus of the present invention is composed of a perceptual entropy calculation medium for calculating the perceptual entropy of a input acoustic signal calculated per each of the respective short conversion blocks; a perceptual entropy sum total calculating medium for obtaining the sum total in the frame of the perceptual entropy calculated by the perceptual entropy calculation medium; a comparison medium for comparing the absolute value of the difference between the respective sum totals in the frame of the perceptual entropy of the two frames being successive in relation to an elapsed time with a previously determined threshold value; and a judgment medium judging that the later frame among the two frames successive in the elapsed time is converted by short blocks when the absolute value is larger than the threshold value as the comparison result obtained by said comparison medium, and that the judgment cannot be performed when the absolute value is smaller than the threshold value.

Moreover, in the digital acoustic signal coding apparatus of the present invention, the threshold value is equal to a value determined per the sampling frequency of the input acoustic signal. The method of coding digital acoustic signal of the present invention includes the steps of:

calculating the perceptual entropy of a input acoustic signal calculated per each of the respective short conversion blocks; obtaining the sum total in the frame of the calculated perceptual entropy; comparing the absolute value of the difference between the respective sum totals in the frame of the perceptual entropy of the two frames being successive in relation to the elapsing time with a previously determined threshold value; and judging whether a long block or a short blocks conversion should be used to convert the block of the input acoustic signal on the basis of the comparison result.

In another method of coding digital acoustic signal of the present invention, when the absolute value is larger than the threshold value, the later frame among the two frames successive in elapsed time is judged to be converted by short blocks conversion; and, when the absolute value is smaller than the threshold value, the later frame among the two frames is judged to be converted by long block conversion.

A further method of coding a digital acoustic signal of the present invention includes the steps of: calculating the perceptual entropy of a input acoustic signal calculated per each of the respective short conversion blocks; obtaining the total sum in the frame of the calculated perceptual entropy; comparing the absolute value of the difference between the respective sum totals in the frame of the perceptual entropy of the two frames being successive in relation to an elapsed time with a previously determined threshold value; and judging the later frame among the two frames successive in the elapsed time to be converted by short blocks conversion when the absolute value is larger than the threshold value, and judging the later frame among the two frames successive in the elapsed time to be converted by long block conversion when the absolute value is smaller than the threshold value.

In the further method of coding digital acoustic signal of the present invention, the threshold value is equal to a value determined per the sampling frequency of the input acoustic signal.

Moreover, by utilizing the recording medium in which a program for practicing the method of coding the digital acoustic signal according to the present invention, the apparatus for constructing the coding system can be widely used for various purposes, without changing the existing system. The above-mentioned recording medium is further described later in more detail.

ASPECTS OF THE EMBODIMENTS OF THE PRESENT INVENTION

The digital acoustic signal coding apparatus of the present invention in which a digital acoustic signal is inputted along a time axis and divided into blocks therealong, processing such as sub-band division, conversion to frequency area, etc. are practiced per each of the respective blocks. The acoustic signal is divided into plural band widths. Coded bits are allocated to each of the respective band widths. A normalized coefficient is obtained corresponding to the coded bit number of the allocated bits. The digital acoustic signal is compressed and coded by quantizing the acoustic signal with the normalized coefficient. When the conversion to the frequency area is performed, the acoustic signal is converted to either one of a long conversion block or plural short conversion blocks. When short conversion blocks are employed, the plural short conversion blocks are divided into the groups of plural blocks respectively including one or plural short conversion blocks. The acoustic signal is quantized causing the one or plural short conversion blocks included in the same group to correspond to a common normalized coefficient.

The digital acoustic signal coding apparatus is composed of a perceptual entropy calculation medium for calculating the perceptual entropy of a input acoustic signal calculated per each of the respective short conversion blocks; a perceptual entropy total sum calculating medium for obtaining the total sum in the frame of the perceptual entropy calculated by the perceptual entropy calculation medium; a comparison medium for comparing the absolute value of the difference between the respective sum totals in the frame of the entropy of the two frames being successive in relation to an elapsed time with a previously determined threshold value; and a long/short block judgment medium for judging whether long block or the short blocks should be used to convert the block of the input acoustic signal on the basis of the comparison result obtained by the comparison medium.

First Embodiment

The first embodiment of the present invention is described hereinafter, referring to the accompanying drawings.

FIG. 1 is a block diagram illustrating the structure of a digital acoustic signal coding apparatus relating to the first embodiment of the invention. The digital acoustic signal coding apparatus of the embodiment as shown in FIG. 1 is constructed with a block dividing medium 11 for dividing the inputted acoustic signal into the predetermined number of blocks, e.g., eight successive blocks in the following explanation; a perceptual entropy calculating medium 12 for calculating the perceptual entropy PE of the respective divided blocks in accordance with the above-mentioned calculation formula; a perceptual entropy total sum calculating medium 13 for obtaining the total sum in the frame of the calculated perceptual entropy; a comparison medium 14 or comparing the absolute value of the difference between the respective total sums, in the frame, of the perceptual entropy of the two frames which are successive in the elapsing time with the predetermined threshold value, and a long/short blocks judgment medium 15 for judging either one of long block conversion or short blocks conversion in accordance with the comparison result.

Figure 2:
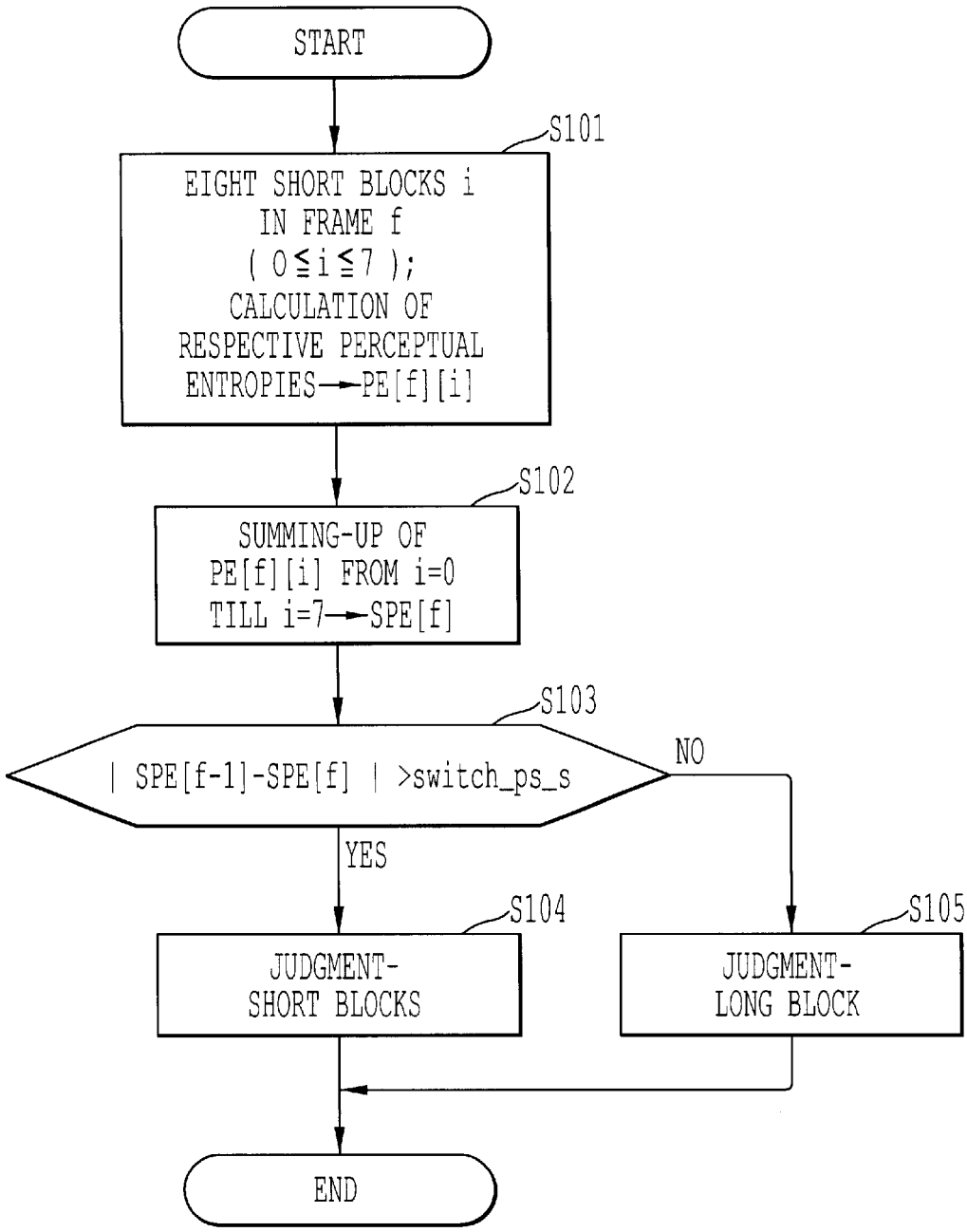
FIG. 2 is a flow chart illustrating the operation of a digital acoustic signal coding method of a first embodiment according to the present invention.
Figure 3:
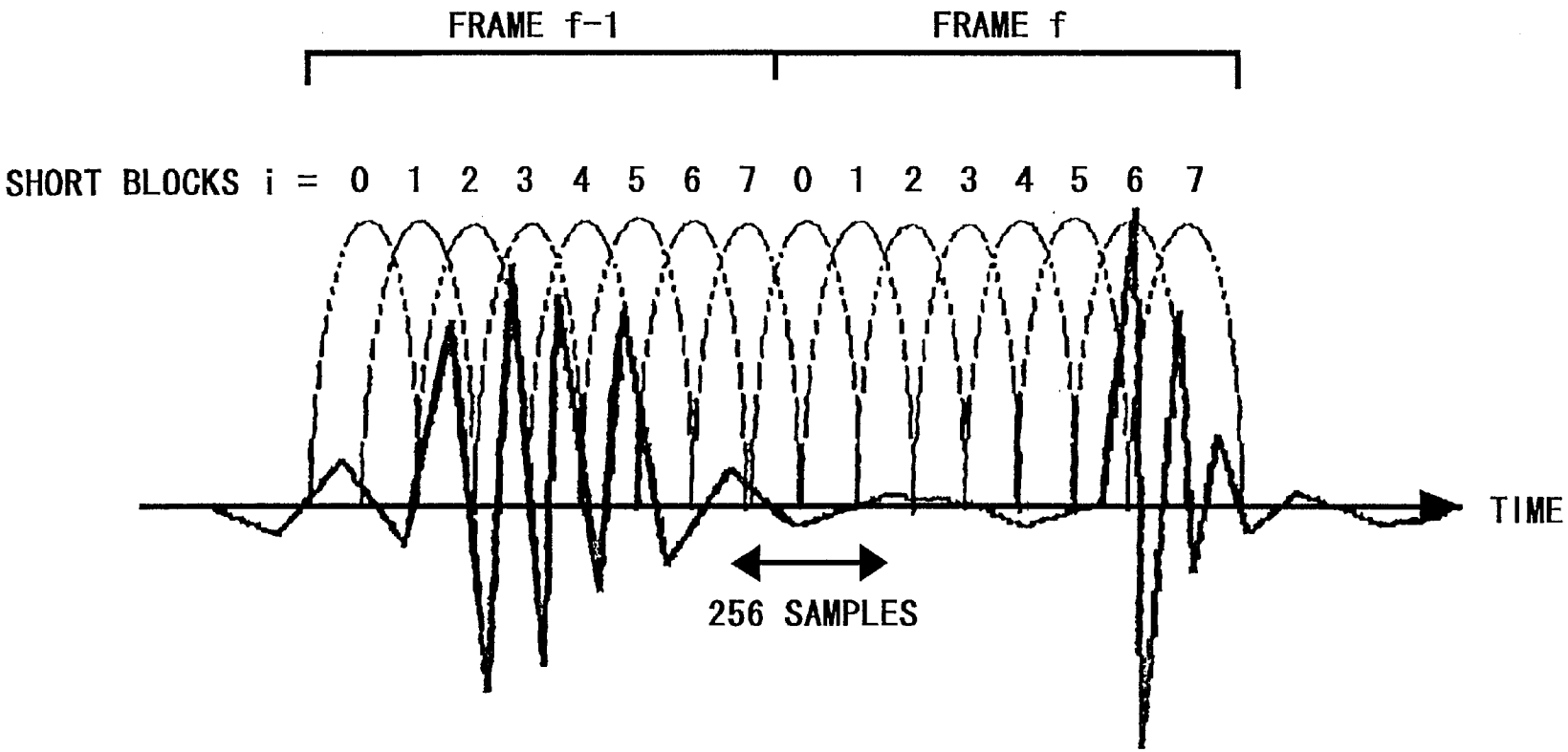
FIG. 3 is an explanatory waveform diagram for explaining, as an example, the signal waveform of the acoustic signal in the first embodiment according to the present invention.

Here, FIG. 2 is a flow chart illustrating the operation of the digital acoustic signal coding apparatus relating to the first embodiment of the invention. The operation of the embodiment is concretely described hereinafter, referring to FIG. 1 and FIG. 2. On that occasion, the acoustic data shown in FIG. 3 are employed as an example of the input acoustic signal. Here, FIG. 3 shows 16 short blocks in total contained in the two frames which are successive in an elapsed time. As to the frame, the frame f−1 and the frame f are arranged in this time order. The noticed frame is the later frame f. The through-out numbers corresponding to the respective short blocks are attached to the respective frames.

At first, the acoustic signal is divided into blocks by the block dividing medium 11 and the entropy calculating medium 12 respectively calculates the sensation perceptual entropy PE[f][I] for the successive eight short blocks I(0≦i≦7) in the frame f (Step S101). The calculation of the perceptual entropy is performed by the method explained in the step 12 of the judgment method of the long/short blocks described in the aforementioned ISO/IEC 13818-7. Next, the summing-up value SPE[f] with respect to 0≦i≦7 of PE[f][I] is obtained as defined in the below equation (2) by use of the entropy total sum calculating medium 13 (Step S102).

$$SPE[f] = \sum_{i=0}^{7} PE[f][i] \qquad \text{[Equation (2)]}$$

The absolute value of the difference between the value of SPE [f−1] previously obtained in the similar way at the preceding frame f−1 by use of the comparing medium 14 and the value of SPE[f]. The absolute value thus obtained is compared with the previously determined threshold value switch_pe_s, namely, the comparison which value is larger is done (Step S103). It is judged that, in the long/short blocks judgment medium 15, when the obtained absolute value is larger than the value switch_pe_s, the step advances to the Step S104 and the frame f is converted with the plural short blocks. On the other hand, it is judged that, in the long/short blocks judgment medium 15, when the obtained absolute value is smaller than the value switch_pe_s, the step advances to the Step S105 and the frame f is converted with the one (single) long block.

FIG. 4 is a diagram (list) showing the values PE[f][I] corresponding to the respective short blocks shown in FIG. 3. In the example shown in FIG. 4;

SPE[f−1]=1390, and

SPE[f]=1030.

Therefore, when switch_pe_s=500,

|SPE[f−1]-SPE[f]|

=360 <switch$_{13}$ pe_s=500.

Consequently, it is judged that, as to the frame f, the conversion should be done with the one (single) long block.

Second Embodiment

Figure 5:
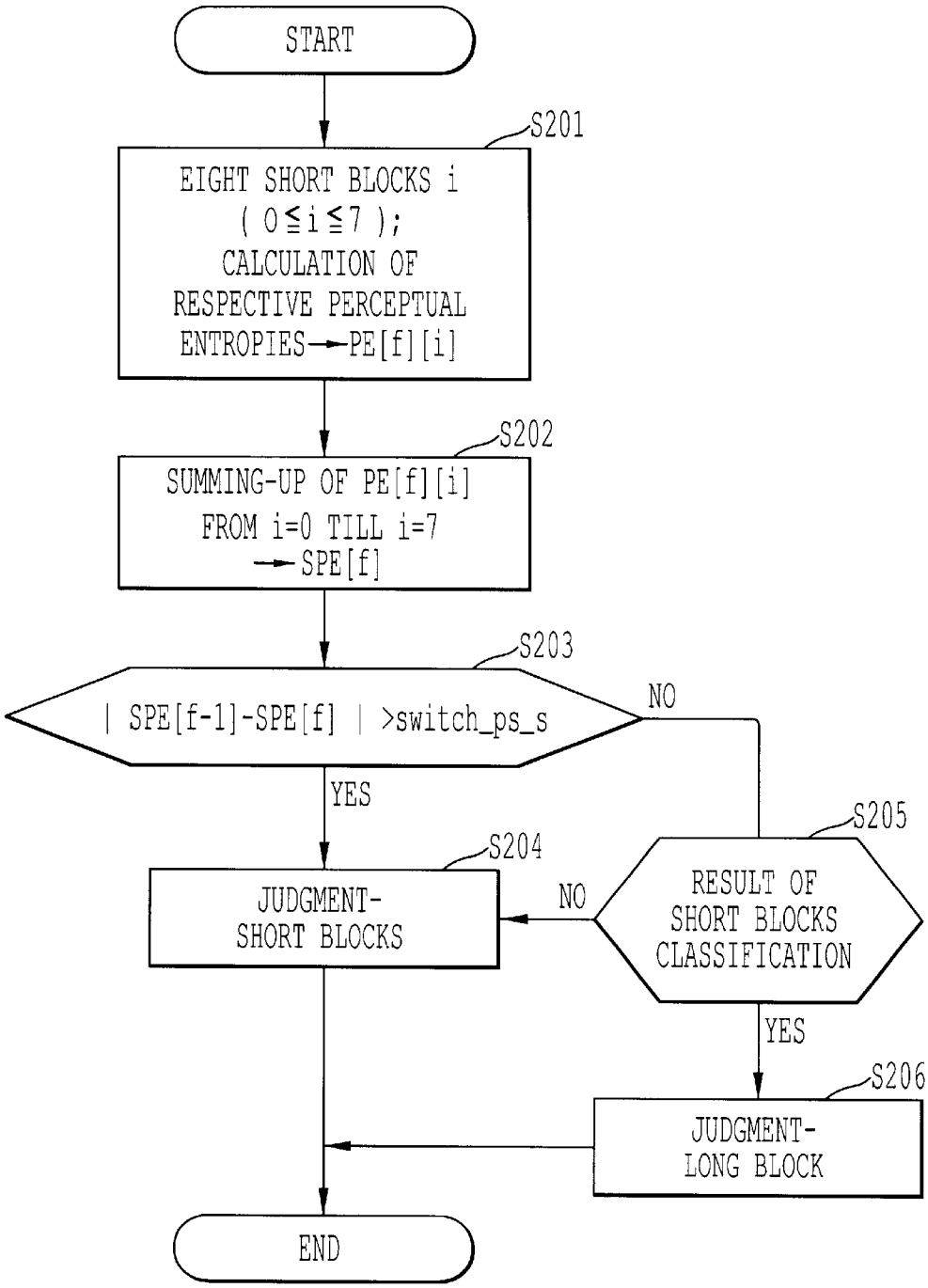
FIG. 5 is a flow chart illustrating the operation of a digital acoustic signal coding method of a second embodiment according to the present invention.

Next, the operation of the digital acoustic signal coding apparatus relating to the second embodiment according to the present invention is explained in accordance with the flow chart shown in FIG. 5. The processes associated with S101–S104 shown in FIG. 2 are the same in the respectively performed with respect to steps S201–S204 shown in FIG. 5. Only different operations are described here, and, thus, the description of these same operations is omitted here.

In step S203, the absolute value of the difference between the value SPE[f−1] which is already obtained at the previous frame f−1 in the same way as mentioned above and the value SPE[f] and the absolute value thus obtained is compared with the predetermined threshold value switch_pe_s. When the obtained absolute value is larger than switch_pe_s, the step advances to step S204 and the frame f is judged to be suitable for conversion with plural short blocks. On the other hand, when the obtained absolute value is smaller than switch_pe_s, the judgment cannot be made based only on the information regarding the difference between the total sum values of the perceptual entropy of the respective short blocks in the frame. Accordingly, the long/short judgment is done differently.

Figure 16A:
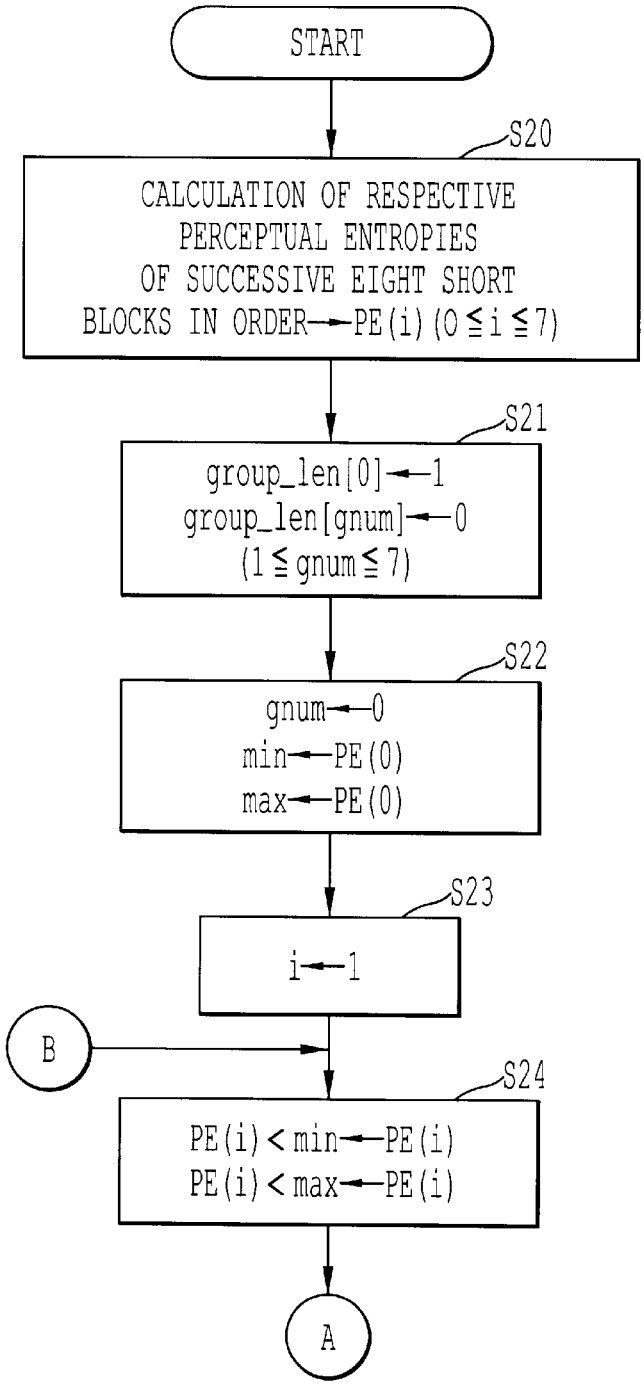
FIG. 16A BACKGROUND ART
FIGS. 16A and 16B are a flow chart illustrating the operation of a background-art digital acoustic signal coding method.
Figure 16B:
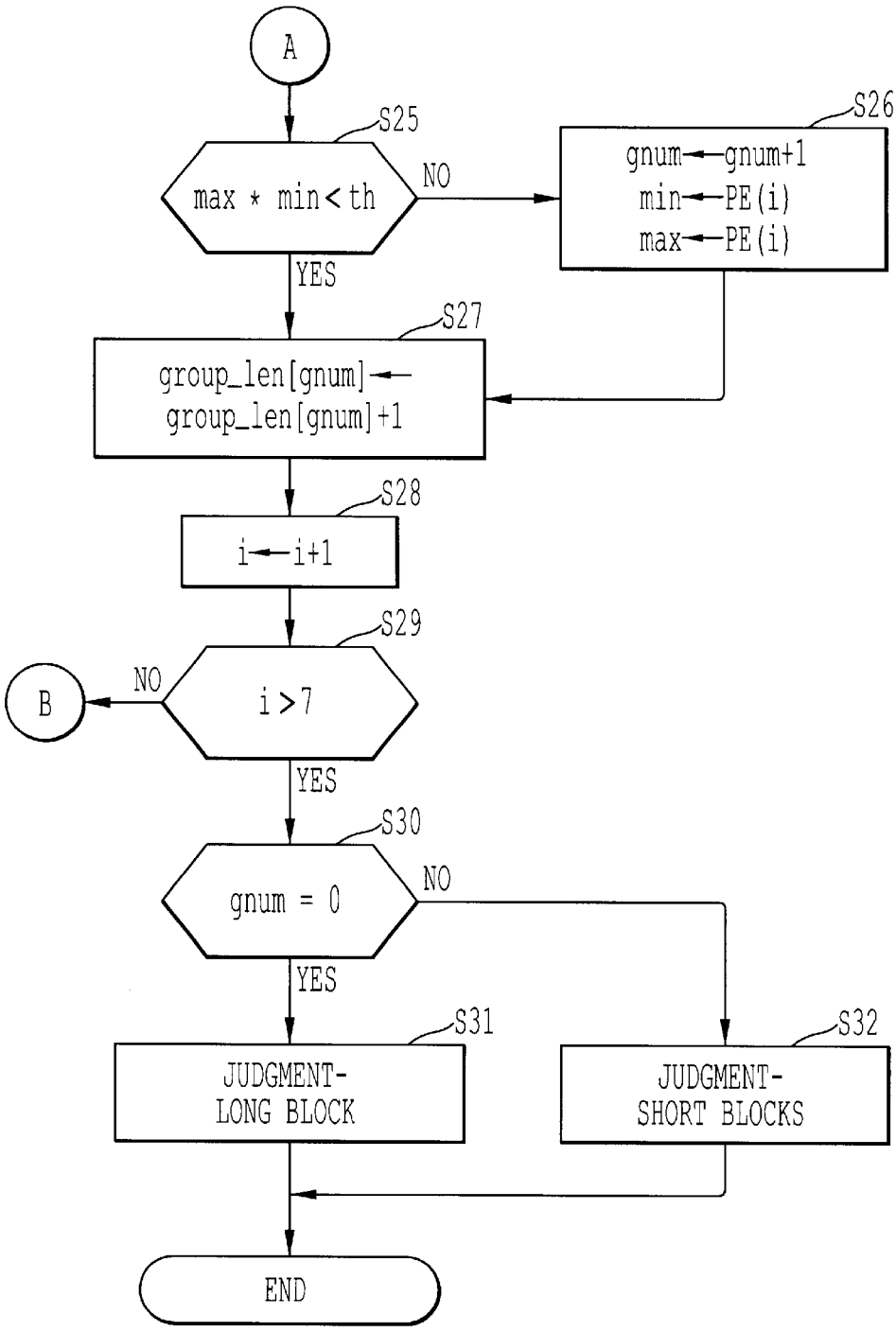
FIG. 16B BACKGROUND ART
Figure 17:
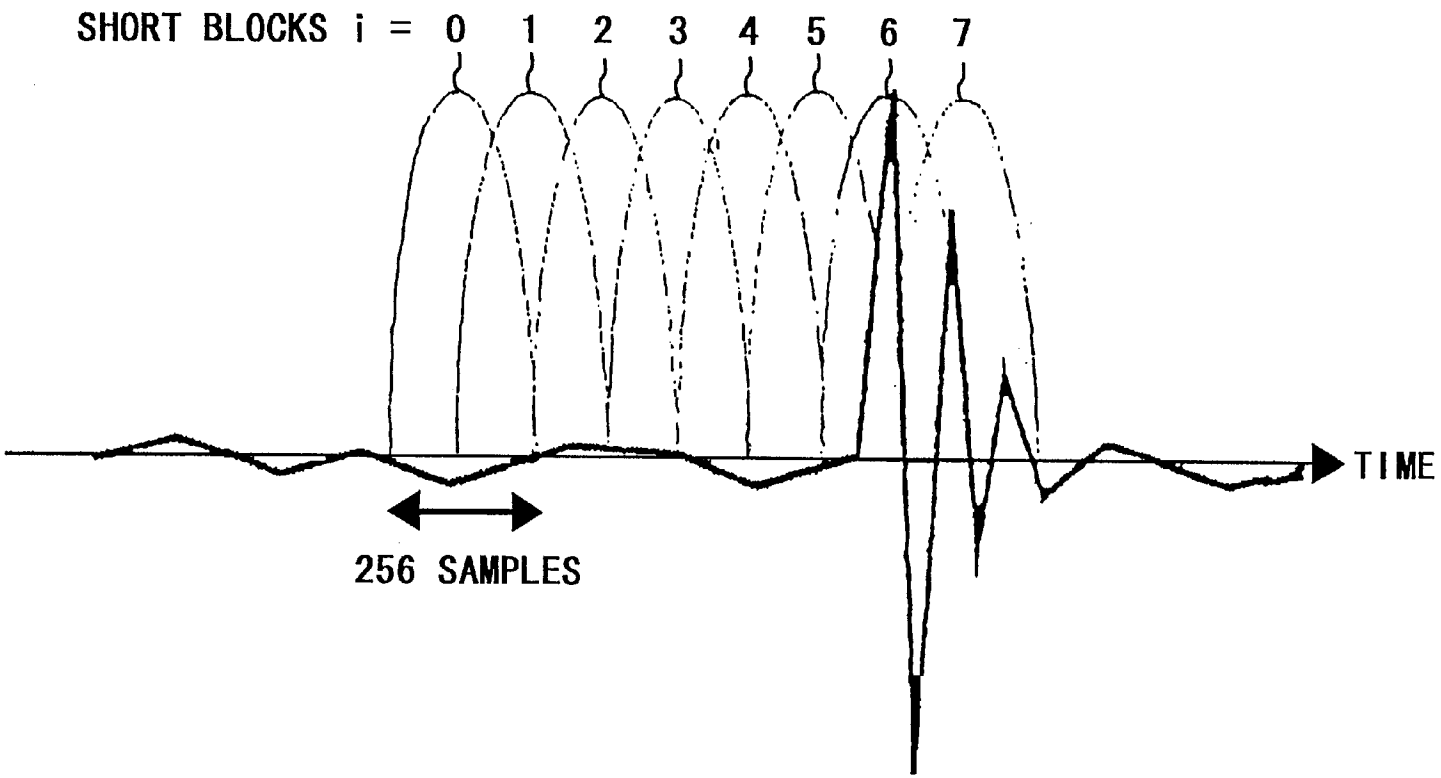
FIG. 17 BACKGROUND ART
FIG. 17 is an explanatory waveform diagram, as an example, of an acoustic signal.
Figure 19A:
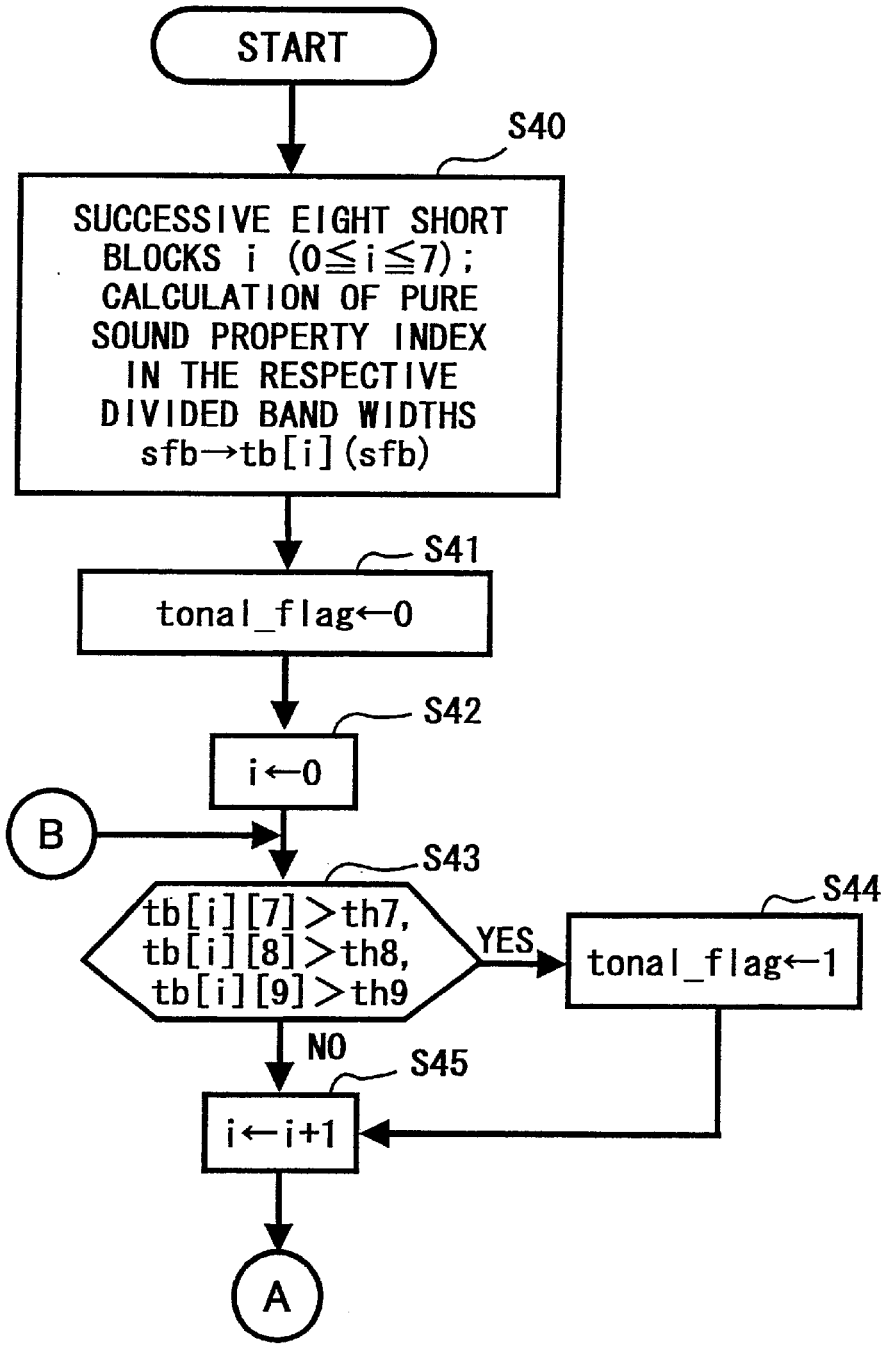
FIG. 19A BACKGROUND ART
FIGS. 19A and 19B are a flow chart illustrating the operation of another digital acoustic signal coding method.
Figure 19B:
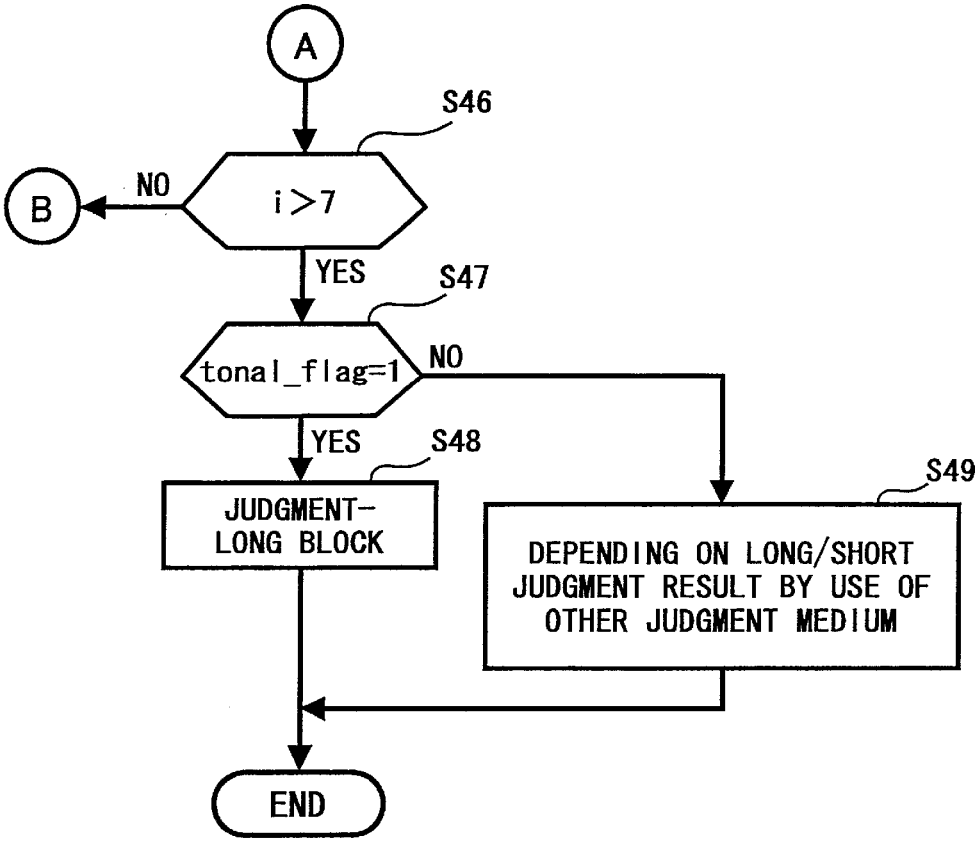
FIG. 19B BACKGROUND ART
Figure 22:
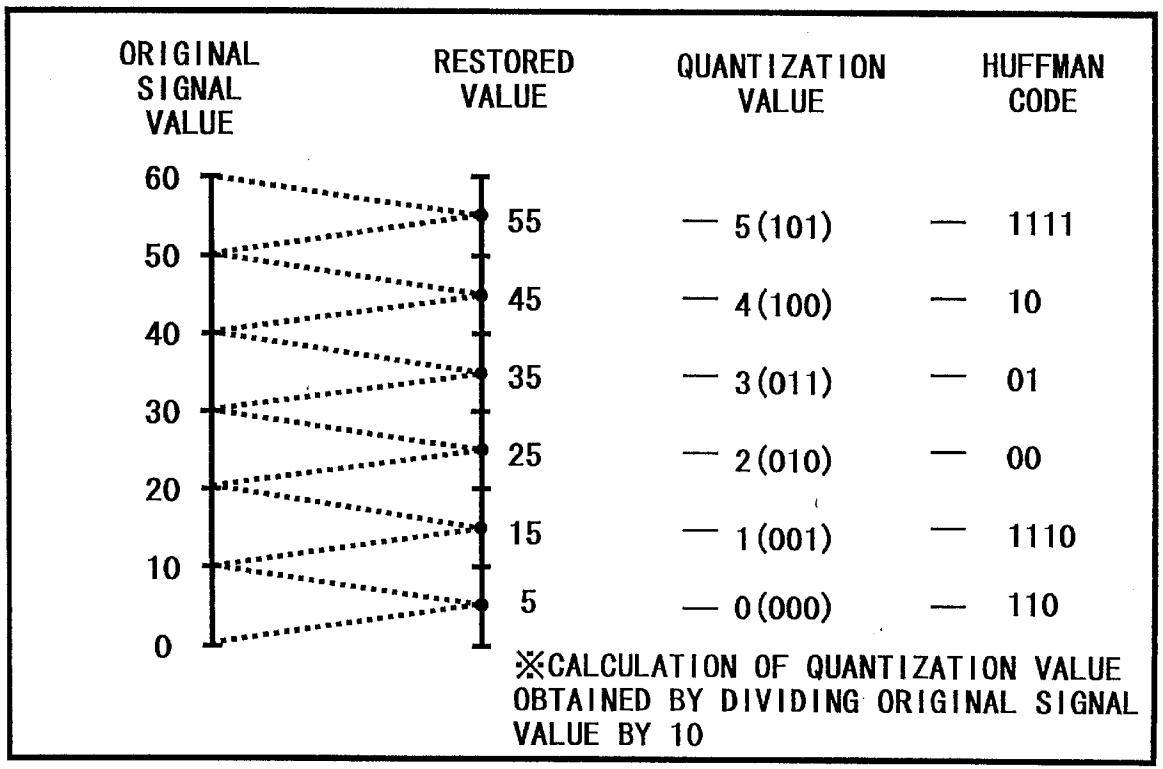
FIG. 22 BACKGROUND ART
FIG. 22 is an explanatory diagram for explaining quantization.
Figure 24A:
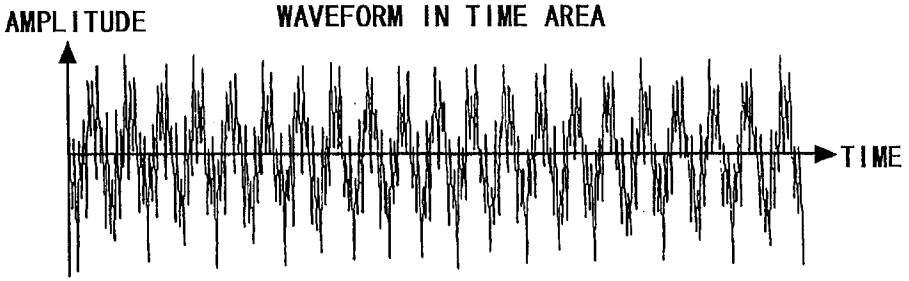
FIG. 24A BACKGROUND ART
Figure 24B:
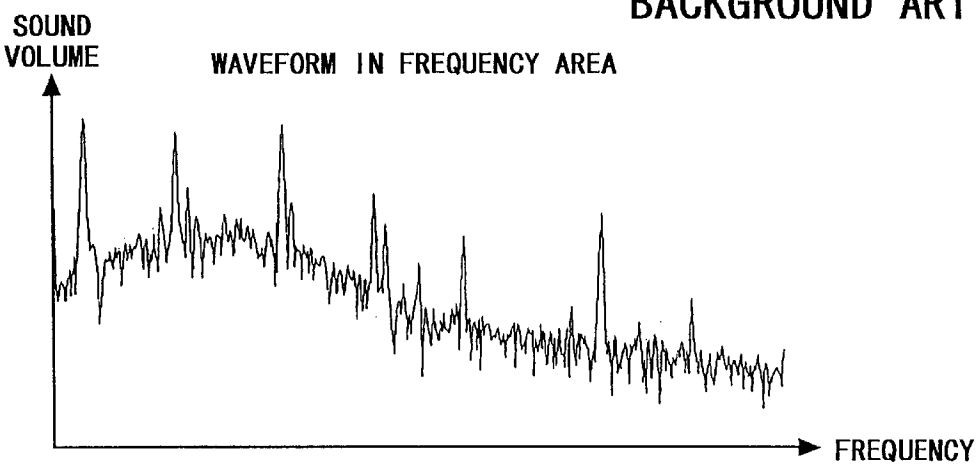
FIG. 24B BACKGROUND ART
Figure 25:
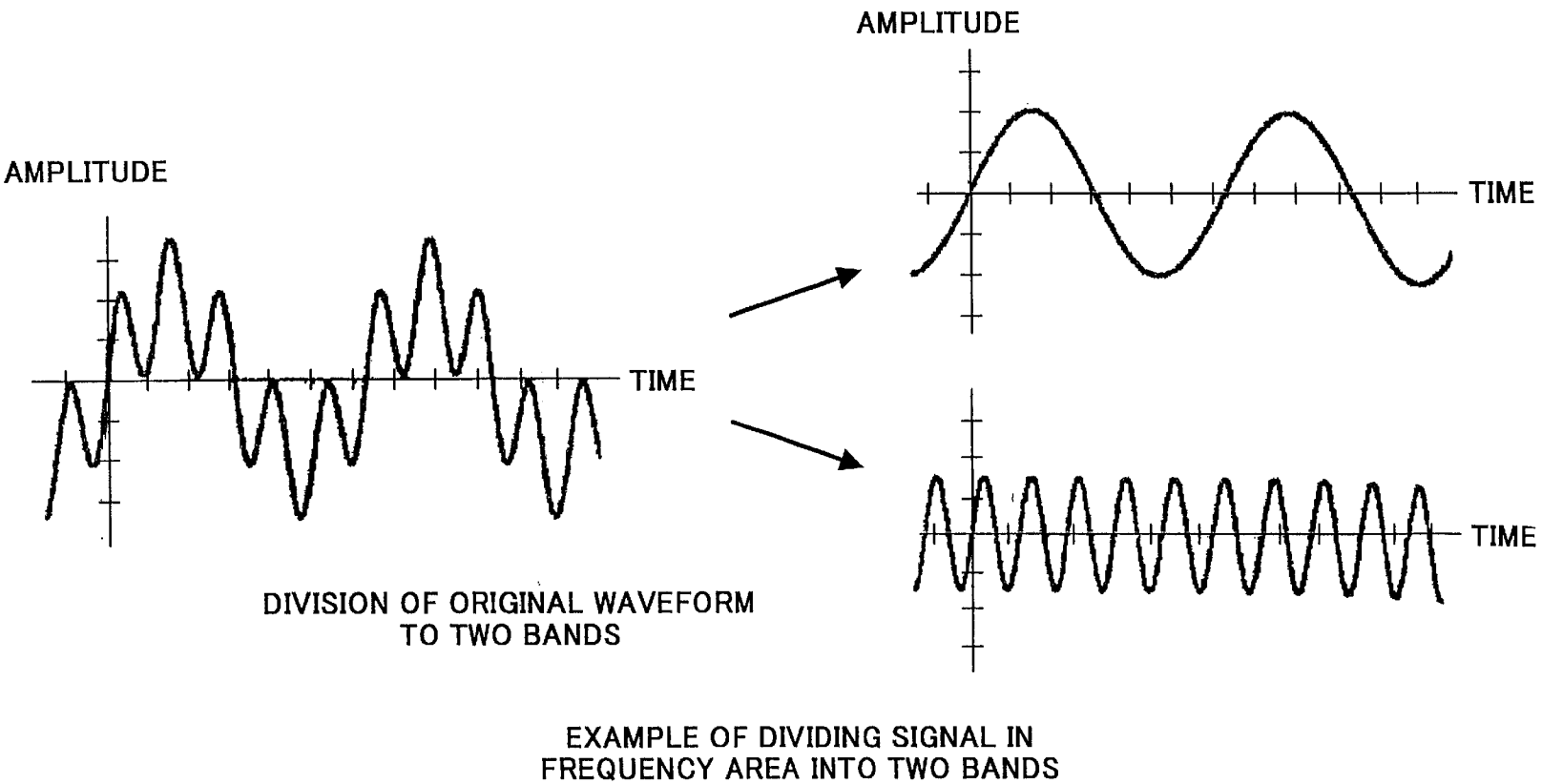
FIG. 25 BACKGROUND ART
FIG. 25 is an explanatory diagram for explaining an example of dividing the signal in the frequency area (domain) into two band widths.
Figure 26:
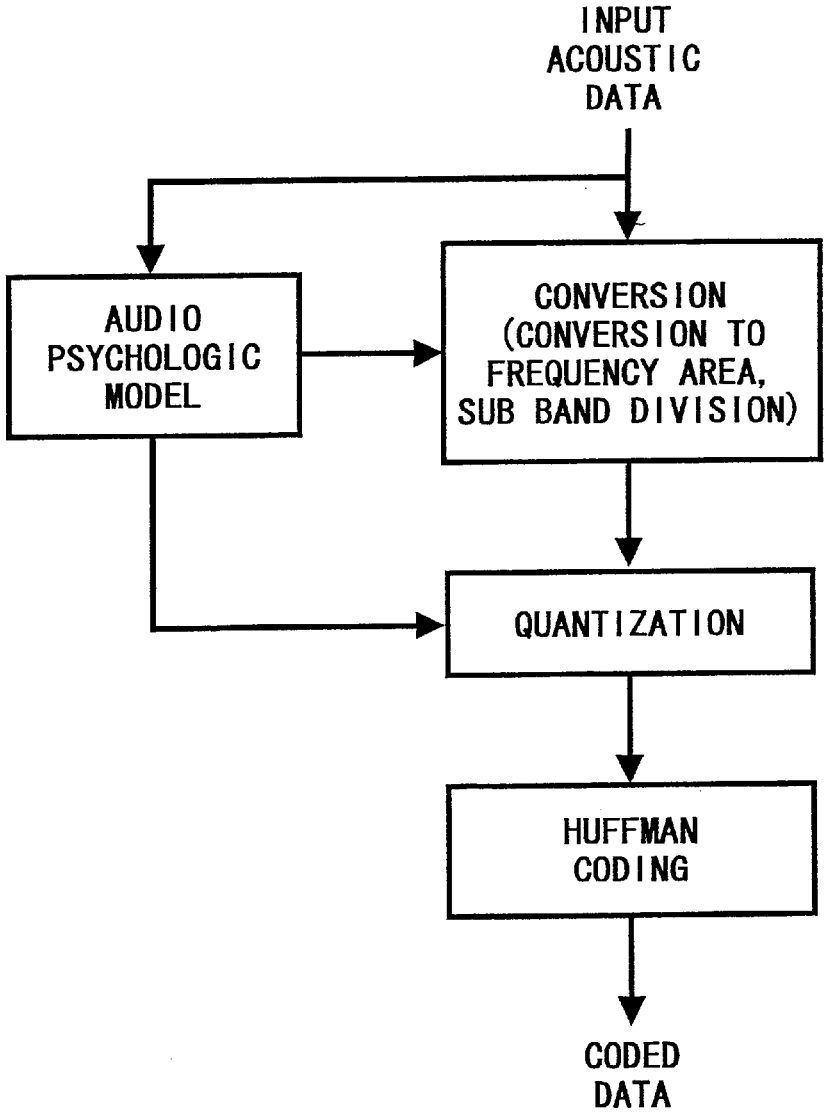
FIG. 26 BACKGROUND ART
FIG. 26 is a signal flow diagram for showing the basic flow of acoustic signal coding.
Figure 27:
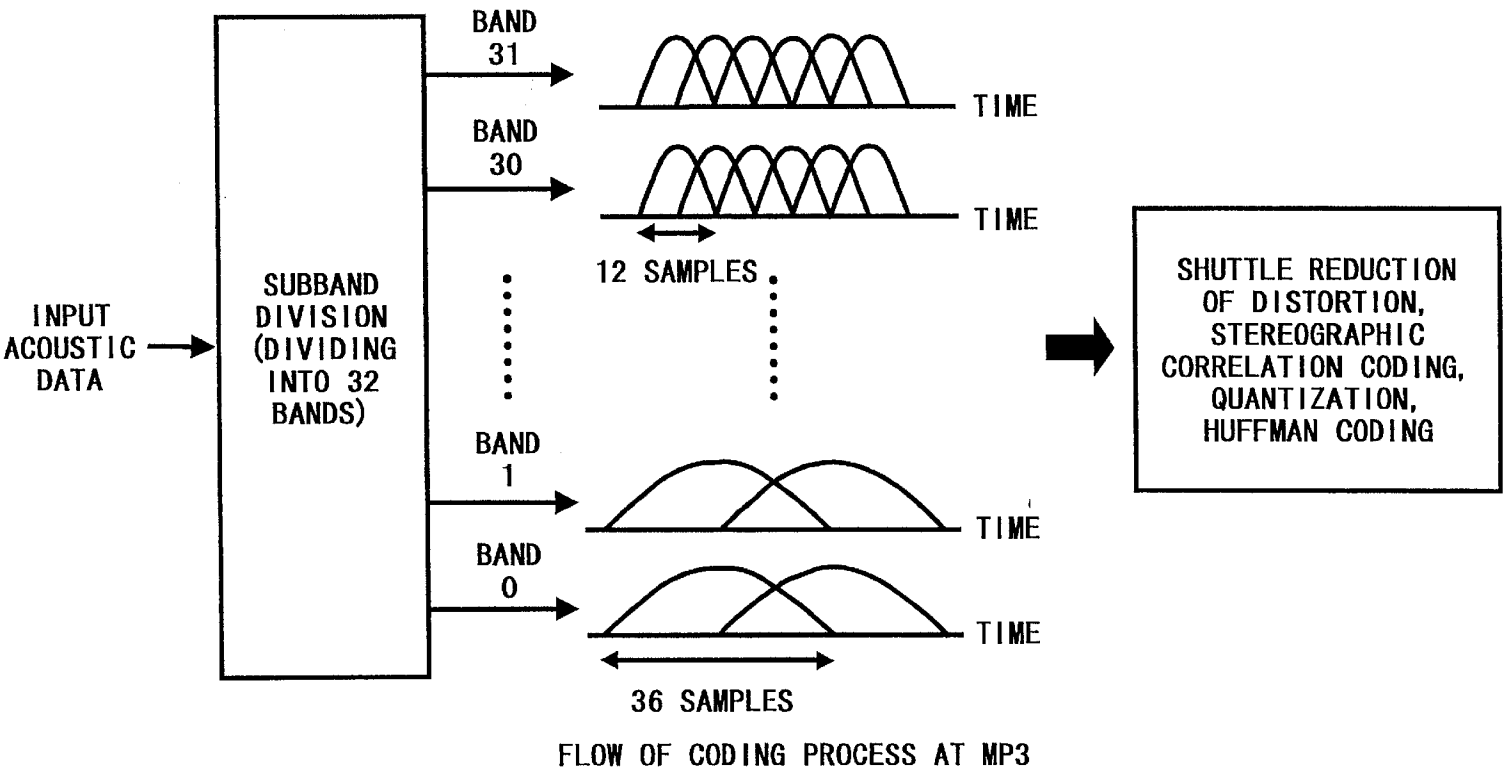
FIG. 27 BACKGROUND ART
FIG. 27 is a signal flow diagram for showing the flow of acoustic signal coding of MP3.

As an example thereof, the frame f is divided (classified) into the groups such that the difference between the maximum value and the minimum value of the perceptual entropy regarding the respective short blocks in the same group becomes smaller than predetermined threshold value. As the result, when the number of the groups is 1, the step advances to the Step S206 and the frame f is converted into the frequency area (domain) with one (single) long block. When the number of the groups is 2 or more, the step advances to the Step S204 and the conversion is judged to be suitable for conversion to plural short blocks. The details of group classification are shown in the flow chart of FIG. 16.

Figure 6:
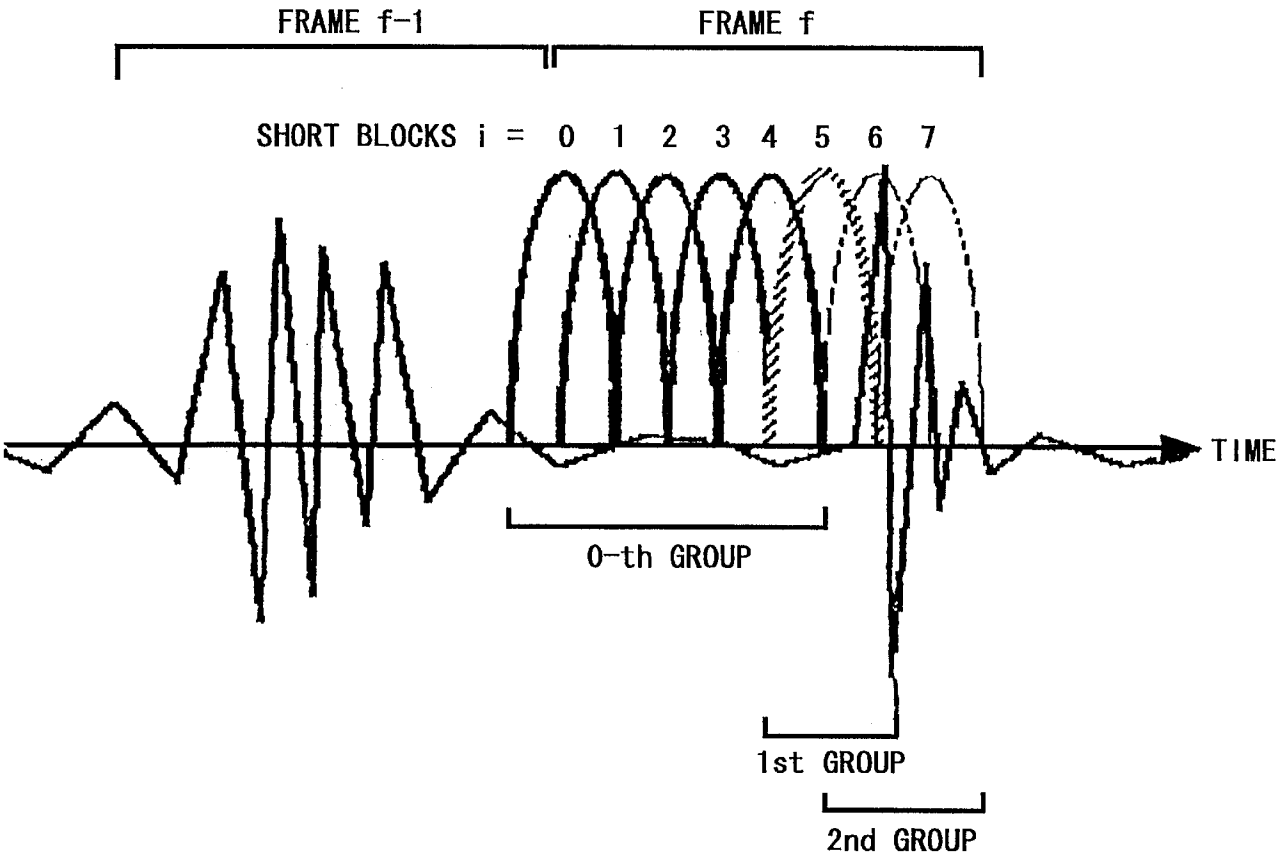
FIG. 6 is an explanatory waveform diagram for explaining group classification in the second embodiment according to the present invention.

As the concrete example, note the drawings including FIG. 6 showing the group classification result of the frame f in addition to FIG. 3 and FIG. 4. Here, switch-pe-s is equal to 500. As mentioned above, since $$|SPE[f-1]-SPE[f]|=360<switch_pe_s=500,$$

it depends on the judgment due to result of the group classification. Since the frame f is classified into three groups in FIG. 6 (O-th group is the short blocks i=0, 1, 2, 3, and 4; First group is the short block i=5; and second groups are the short blocks i=6 and 7), the conversion is judged to be a suitable one using plural short blocks. The long/short judgment method employed in the Step S205 is not limited to the method based on the result of the group classification employed here. It is allowable to employ another judgment method.

Third Embodiment

Furthermore, although one of switch_pe_s is determined in FIG. 2 and FIG. 5, it is also allowable to previously determine the value per each of the sampling frequencies of the input acoustic signal as in the case of FIG. 7 showing the example of the value of switch_pe_s per each of the sampling frequencies, and set the value of switch_pe_s, referring to FIG. 7, in accordance with the sampling frequency of the acoustic signal inputted practically.

Figure 8:
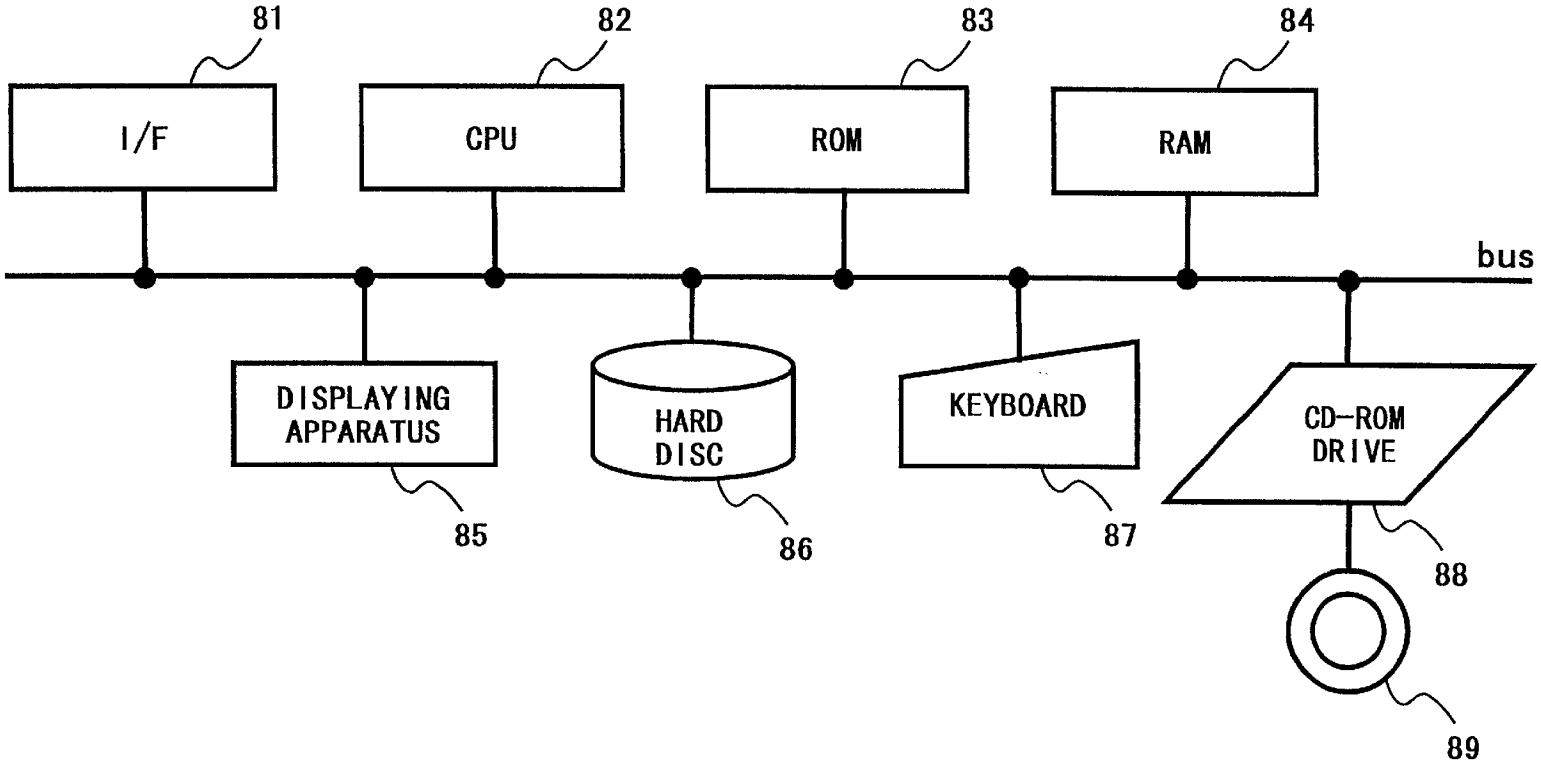
FIG. 8 is a system block diagram illustrating the structure of the system of the present invention.
Figure 9:
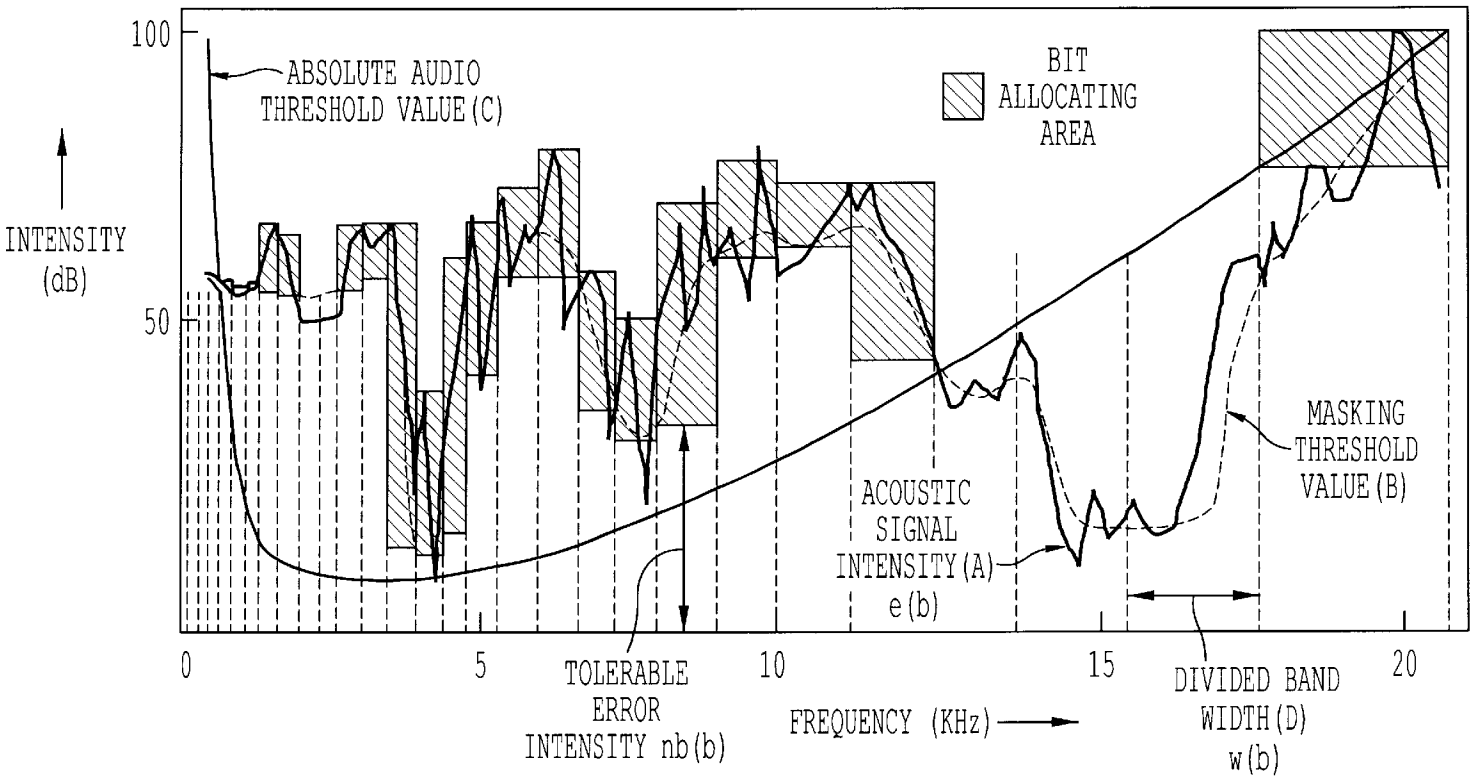
FIG. 9 BACKGROUND ART
FIG. 9 is an explanatory waveform diagram for explaining the intensity distributions of an acoustic signal, the masking threshold value, and the absolute audio threshold value.
Figure 10:
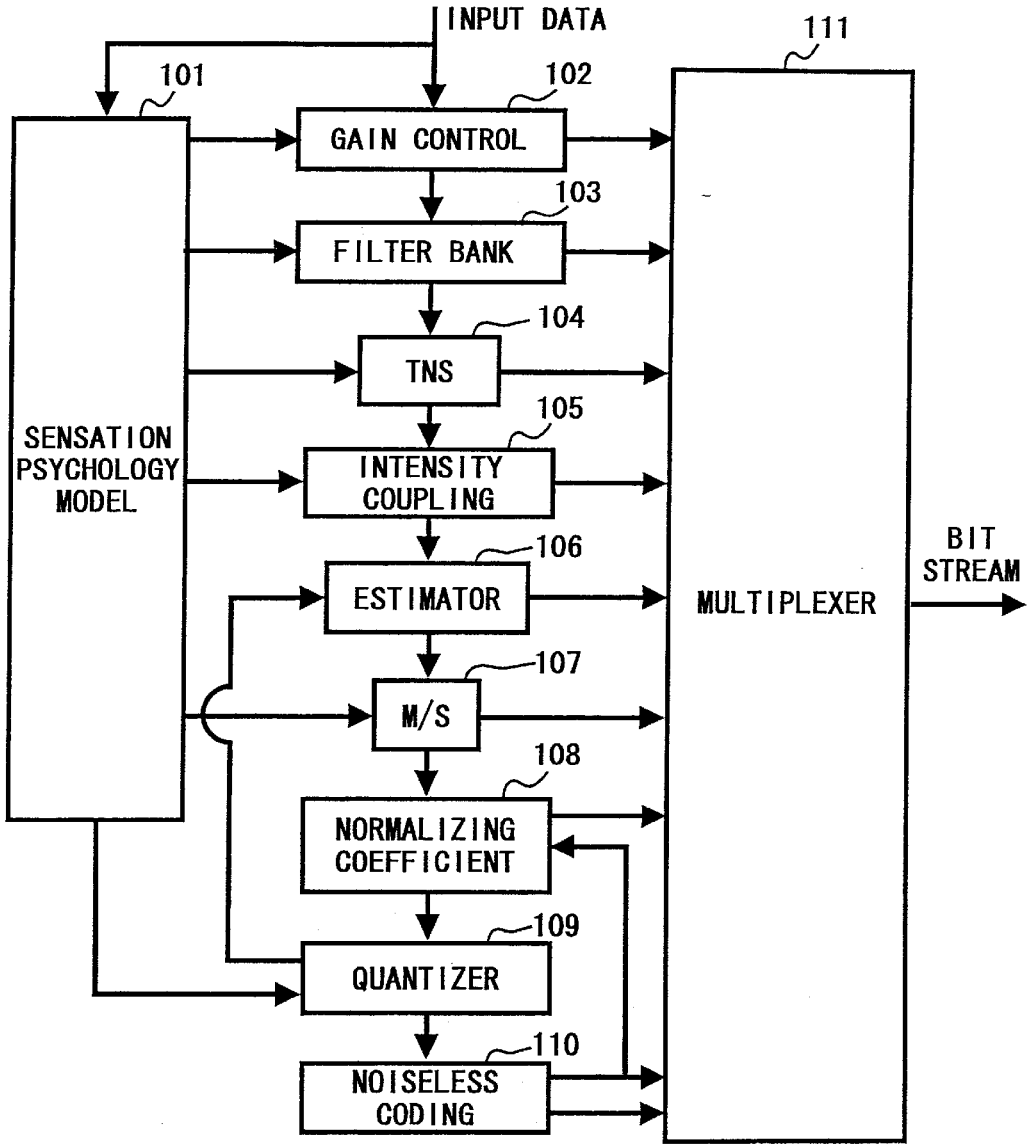
FIG. 10 BACKGROUND ART
FIG. 10 is a block diagram illustrating the basic structure of AAC coding.
Figure 11:
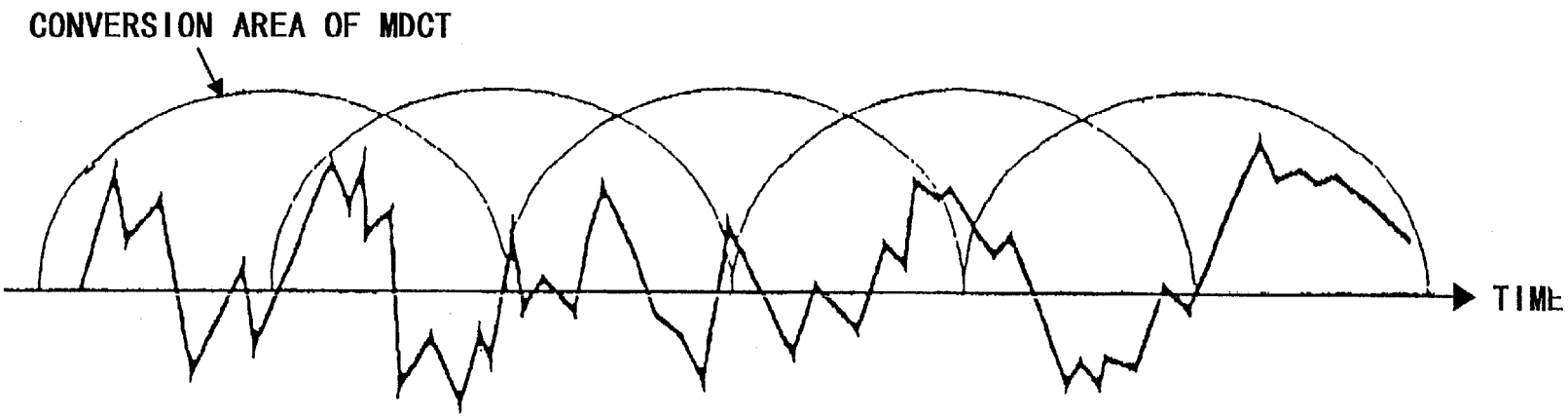
FIG. 11 BACKGROUND ART
FIG. 11 is a diagram showing the conversion area of MDCT.
Figure 12:
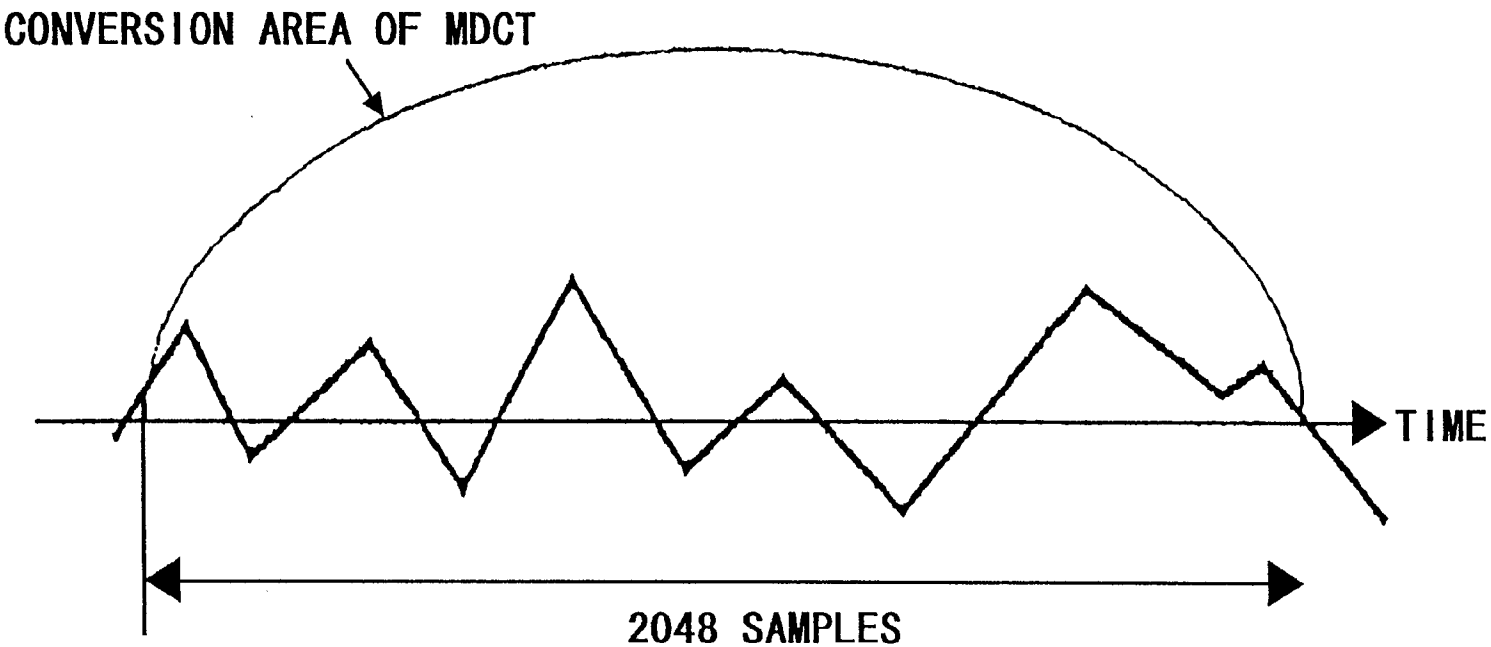
FIG. 12 BACKGROUND ART
FIG. 12 is a diagram showing the conversion area of MDCT for a waveform of a signal changing a little bit.
Figure 13:
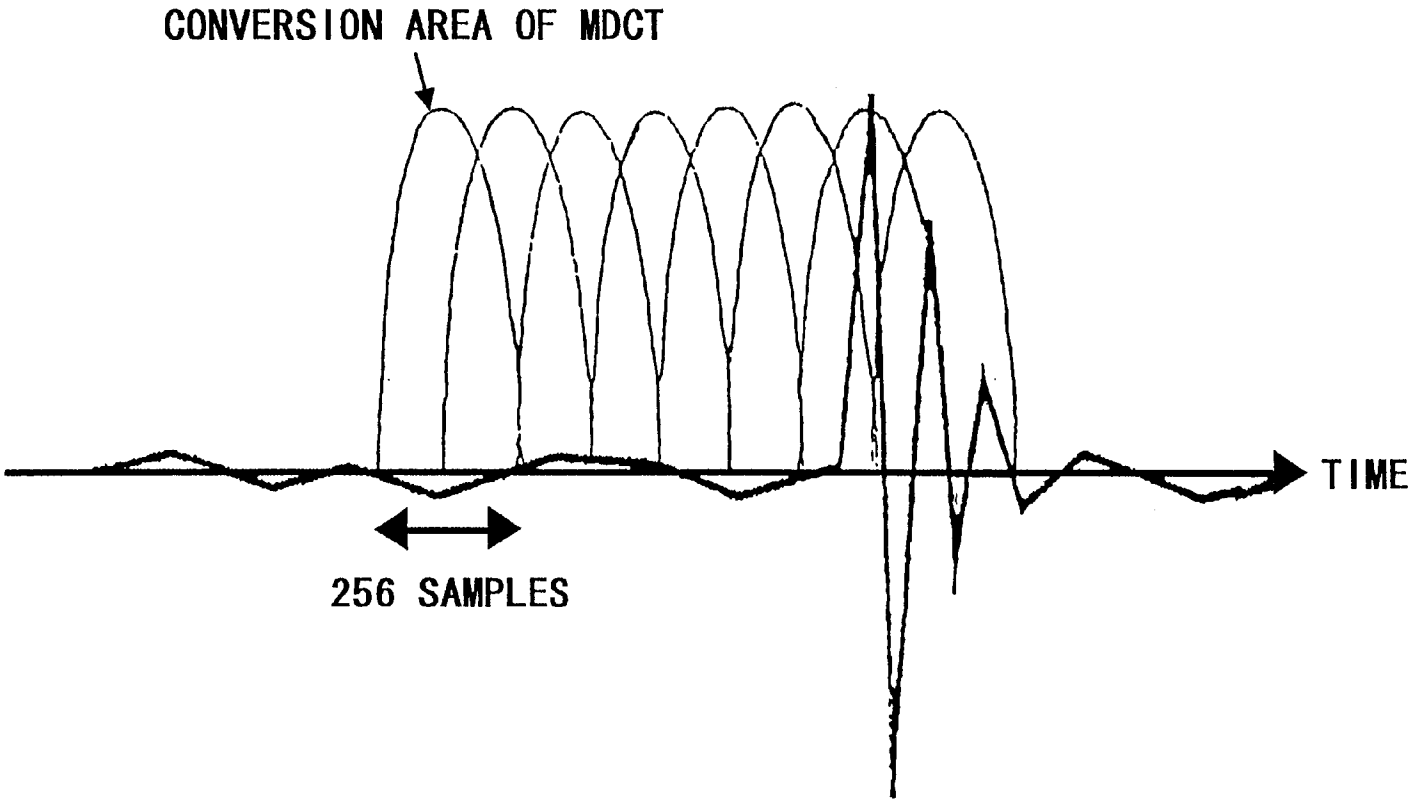
FIG. 13 BACKGROUND ART
FIG. 13 is a diagram showing a waveform of a signal changing violently (sharply)
Figure 14:
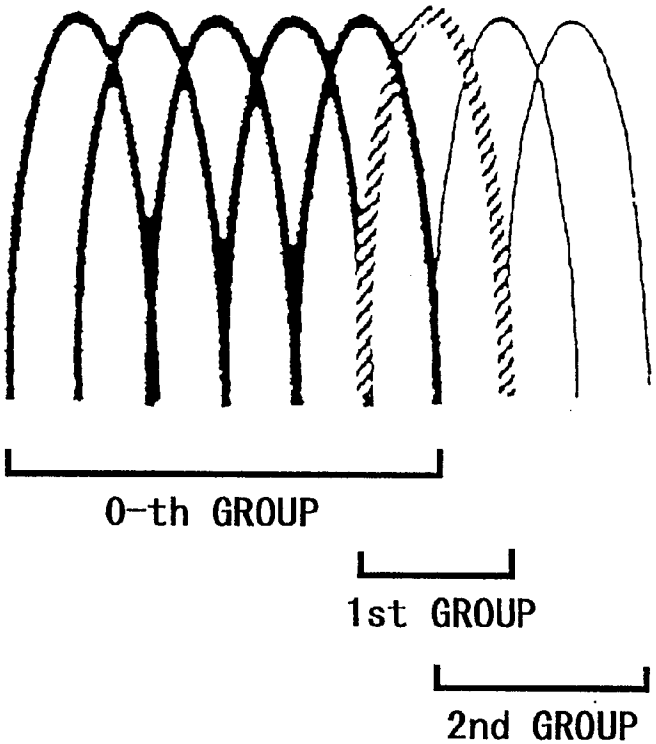
FIG. 14 BACKGROUND ART
FIG. 14 is an explanatory diagram for explaining an example of a group classification.
Figure 15:
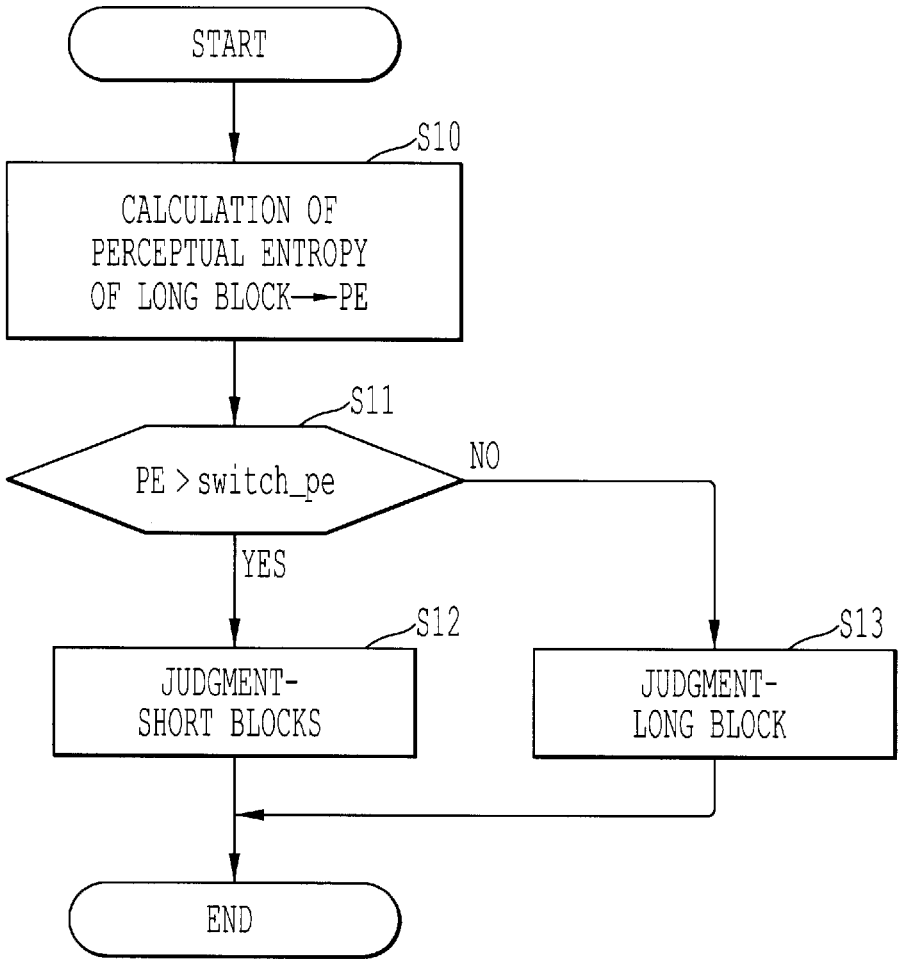
FIG. 15 BACKGROUND ART
FIG. 15 is a flow chart illustrating the long/short blocks judgment operation of ISO/IEC 13818-7.

Next, the system structure of the present invention is illustrated in the block diagram of FIG. 8. Namely, FIG. 8 shows hardware constructed with a microprocessor controlled by software using digital acoustic signal coding methods of the above-mentioned embodiments. In FIG. 8, the digital acoustic signal coding system is constructed with an interface (hereinafter, abbreviated as I/F) 81, a CPU 82, a ROM 83, a RAM 84, A displaying apparatus 85, a hard disc 86, a keyboard 87, and a CD-ROM drive 88.

Furthermore, the commonly-used processing apparatus is prepared, and the program for practicing the method of coding the digital acoustic signal according to the present invention is recorded in a recording medium capable of being read, such as the CD-ROM 89, etc. The control signal is inputted from the external apparatus via the I/F 81, and the operator issues a command (instruction) by operating the keyboard 87 or the program of the present invention is automatically initialized. The CPU 82 practices the coding control process in accordance with the above-mentioned digital acoustic signal coding methods under control of the above noted program. The result of the process is stored in the memorizing apparatus (memory) such as the RAM 84, the hard disc 86, etc. The information thus stored is outputted to the display apparatus 85 as occasion demands.

As mentioned heretofore, by utilizing a recording medium for recording the program practicing the methods of coding the digital acoustic signal according to the present invention, the apparatus for constructing the coding system can be commonly employed, without changing the system commonly used at present.

The details of a recording medium suitable for use as part of the present invention is further described, hereinafter.

A recording medium suitable for use as part of the present invention is employed for recording a program for controlling coding performed by the digital acoustic signal coding apparatus. In the recording medium, the digital acoustic signal is inputted along a time axis and divided into blocks therealong by use of a computer. Processes, such as sub-band division or conversion to frequency area (domain), etc. are practiced per each of the respective blocks. The acoustic signal is divided into plural band widths. Coded bits are allocated to each of the respective band widths. A normalized coefficient is obtained corresponding to the coded bit number of the allocated bits. The digital acoustic signal is compressed and coded by quantizing the acoustic signal with the normalized coefficient. When the conversion to the frequency area (domain) is performed, the acoustic signal divided into the blocks is converted to either one of a long conversion block or plural short conversion blocks. When the short conversion blocks are employed, the plural short conversion blocks are divided into groups of plural blocks, respectively, including one or plural short conversion blocks. The acoustic signal is quantized, causing one or plural short conversion blocks included in the same group to correspond to a common normalized coefficient.

The recording medium has functions of: calculating perceptual entropy of an input acoustic signal calculated per each of the respective short conversion blocks; obtaining the total sum in the frame of said calculated perceptual entropy; comparing the absolute value of the difference between the respective total sums in the frame of the perceptual entropy of the two frames being successive in relation to an elapsed time with a previously determined threshold value; and judging whether the long block or the short blocks should be used to convert a block of said input acoustic signal on the basis of the comparison result.

Another recording medium of the present invention can also employed for recording a program of coding the digital acoustic signal coding apparatus. In this another recording medium, the digital acoustic signal is inputted along a time axis and divided into blocks therealong by use of a computer. Processes such as sub-band division or conversion to the frequency area (domain), are practiced per each of the respective blocks. The acoustic signal is divided into plural band widths. Coded bits are allocated to each of the respective band widths. A normalized coefficient is obtained corresponding to the coded bit number of the allocated bits. The digital acoustic signal is compressed and coded by quantizing the acoustic signal with the normalized coefficient. When the conversion to the frequency area (domain) is performed, the acoustic signal divided into blocks is converted to either one of a long conversion block or plural short conversion blocks. When the short conversion blocks are employed, these plural short conversion blocks are divided into the groups of plural blocks respectively including one or plural short conversion blocks. The acoustic signal is quantized, causing one or plural short conversion blocks included in the same group to correspond to a common normalized coefficient. This another recording medium has functions of: calculating the perceptual entropy of a input acoustic signal calculated per each of the respective short conversion blocks; obtaining the total sum in the frame of said calculated perceptual entropy; comparing the absolute value of the difference between the respective total sums in the frame of the perceptual entropy of the two frames being successive in relation to an elapsed time with a previously determined threshold value; and judging the later frame among the two frames successive in the elapsed time to be converted by short blocks conversion when the absolute value is larger than the threshold value, and judging the later frame among the two frames successive in the elapsed time to be converted by long block conversion when the absolute value is smaller than the threshold value.

Heretofore, the digital acoustic signal coding apparatus, the method of coding the digital acoustic signal, and the recording medium for recording the program of coding the digital acoustic signal, have been described.

However, the present invention is not limited to the above-mentioned embodiments. Namely, it is needless-to-mention that various sorts of the modifications, variations, or replacements can be used, without departing from the scope of the invention as described in the appended claims.

As is apparent from the foregoing description, an embodiment of the present invention is featured in that a digital acoustic signal coding apparatus is constructed with a calculating medium for calculating a perceptual entropy of an input acoustic signal, a total sum calculating medium for calculating perceptual entropy total sum in a frame, a comparing medium for comparing the absolute value of the difference between the respective total sums in the frame with a predetermined threshold value, and a long/short block judging medium for judging whether long block conversion or the short blocks conversion is to use to convert a block of an input acoustic signal on the basis of the comparison result. Furthermore, this embodiment is featured in that the long/short block judgement medium judges that the later frame among the two frames successive in an elapsed time is converted by short block conversion when the absolute value is larger than the threshold value as the comparison result obtained by the comparison medium, while the long/short block judgment medium judges that the later frame among said two frames is converted by long block conversion when the absolute value is smaller than the threshold value.

Consequently, it is possible to provide a digital acoustic signal coding apparatus capable of performing the long/short judgment corresponding to an input acoustic signal property.

In another embodiment of the present invention, a digital acoustic signal coding apparatus is constructed with a calculating medium for calculating perceptual entropy of an input acoustic signal, a total sum calculating medium for calculating the total sum of perceptual entropy in a frame, a comparing medium for comparing the absolute value of a difference between respective total sums in the frame with the predetermined threshold value, and a judgment medium judging that the later frame among the two frames successive in an elapsed time should be converted by short blocks conversion when the absolute value is larger than the threshold value as the comparison result obtained by the comparison medium, and the judgment cannot be performed when the absolute value is smaller than the threshold value.

Consequently, it is possible to provide a digital acoustic signal coding apparatus capable of performing a judgment of block conversion further reflecting a property of the input acoustic signal.

Furthermore, the threshold value is determined per each of the sampling frequencies of the input acoustic signal, and thereby the suitable long/short judgment can be performed corresponding to the difference between the sampling frequencies of the input acoustic signal.

In still another embodiment of the present invention, the method of coding a digital acoustic signal comprises the steps of: calculating perceptual entropy of an input acoustic signal calculated per each of respective short conversion blocks; obtaining a total sum in a frame of the calculated perceptual entropy; comparing the absolute value of the difference between the respective total sums in the frame of the perceptual entropy of the two frames being successive in relation to an elapsed time with a previously determined threshold value; and judging whether a long block or short blocks should be used to convert a block of the input acoustic signal on the basis of the comparison result.

Consequently, it is possible to provide a method of coding a digital acoustic signal capable of performing long/short conversion block judgment corresponding to a property of the input acoustic signal.

Furthermore, the method of coding digital acoustic signal comprises the steps of: calculating perceptual entropy of an input acoustic signal calculated per each of the respective short conversion blocks; obtaining a sum in a frame of the total calculated perceptual entropy; comparing the absolute value of the difference between the respective sum totals in the frame of the perceptual entropy of the two frames being successive in relation to an elapsed time with a previously determined threshold value; and judging the later frame among the two frames successive in the elapsed time to be converted by short blocks conversion when the absolute value is larger than the threshold value, and judging the later frame among the two frames successive in the elapsed time to be converted by long block conversion when the absolute value is smaller than the threshold value.

Consequently, it is possible to provide a digital acoustic signal coding method capable of performing a judgment of the block conversion further reflecting a property of the input acoustic signal.

Furthermore, by employing a recording medium in which a program for practicing the digital acoustic signal coding methods according to the present invention, the apparatus for constructing the coding system can be one commonly used, without changing the system used heretofore.

The preferred embodiments of the present invention have been described above. However, numerous additional modifications and variations of the present invention are possible in light of the above teachings. It is therefore to be understood that, within the scope of the appended claims, the present invention may be practiced otherwise than as specifically described herein.

This application claims benefit of priority under 35 U.S.C. 119 to Japanese Patent Application No. 11-222054 filed in the Japanese Patent Office on Aug. 5, 1999, the entire contents of which are incorporated by reference.

What is claimed as new and is desired to be secured by Letters Patent of the United States is:

1. A digital acoustic signal coding apparatus in which a digital acoustic signal is inputted along a time axis and divided into blocks therealong, processes of at least sub-band division or conversion from time to frequency area are practiced per each of the respective blocks said acoustic signal is divided into plural band widths, coded bits are allocated to each of said respective band widths, a normalized coefficient is obtained corresponding to the coded bit number of the allocated bits, and said digital acoustic signal is compressed and coded by quantizing said acoustic signal with said normalized coefficient, wherein, when the conversion to said frequency area is performed, said acoustic signal divided into the blocks is converted to either one of a long conversion block or plural short conversion blocks;

wherein, when said short conversion blocks are employed, said plural short conversion blocks are divided into groups of plural blocks respectively including one or plural short conversion blocks;

wherein said acoustic signal is quantized by a quantizing medium configured to cause one or plural short conversion blocks included in the same group to correspond to a common normalized coefficient; and wherein said digital acoustic signal coding apparatus comprises:

a perceptual entropy calculation medium configured to calculate perceptual entropy of an input acoustic signal per each of said respective short conversion blocks;

a perceptual entropy total sum calculation medium configured to obtain a total sum in a frame of said perceptual entropy calculated by said perceptual entropy calculation medium;

a comparison medium configured to compare the absolute value of a difference between respective total sums of two frames of perceptual entropy that are successive in relation to the an elapsed time with a previously determined threshold value; and a long/short blocks judgment medium configured to judge whether long block conversion or short blocks conversion should be used to convert a block of said input acoustic signal blocks on the basis of the comparison result obtained by said comparison medium.

2. The digital acoustic signal coding apparatus as defined in claim 1, wherein, when said absolute value is larger than said threshold value as the comparison result obtained by said comparison medium, said long/short blocks judgment medium judges that the later frame among said two frames successive in the elapsed time is converted by said short blocks; and wherein, when said absolute value is smaller than said threshold value, said long/short blocks judgment medium judges that the later frame among said two frames is converted by said long block.

3. The digital acoustic signal coding apparatus as defined in claim 2, wherein said threshold value is equal to a value determined per the sampling frequency of said input acoustic signal.

4. The digital acoustic signal coding apparatus as defined in claim 1, wherein said threshold value is equal to a value determined per the sampling frequency of said input acoustic signal.

5. A digital acoustic signal coding apparatus in which a digital acoustic signal is inputted along a time axis and divided into blocks therealong, processes of at least subband division or conversion from time to frequency area are practiced per each of the respective blocks said acoustic signal is divided into plural band widths, coded bits are allocated to each of said respective band widths, a normalized coefficient is obtained corresponding to the coded bit number of the allocated bits, and said digital acoustic signal is compressed and coded by quantizing said acoustic signal with said normalized coefficient, wherein, when the conversion to said frequency area is performed, said acoustic signal divided into the blocks is converted to either one of a long conversion block or plural short conversion blocks;

wherein, when said short conversion blocks are employed, said plural short conversion blocks are divided into groups of plural blocks respectively including one or plural short conversion blocks;

wherein said acoustic signal is quantized by a quantizing medium configured to quantize one or plural short conversion blocks included in the same group to correspond to a common normalized coefficient; and wherein said digital acoustic signal coding apparatus comprises:

a perceptual entropy calculation medium configured to calculate perceptual entropy of an input acoustic signal per each of said respective short conversion blocks;

a perceptual entropy total sum calculating medium configured to obtain a total sum in a frame of said perceptual entropy calculated by said perceptual entropy calculation medium;

a comparison medium configured to compare the absolute value of a difference between the respective total sums of two frames of perceptual entropy that are successive in relation to an elapsed time with a previously determined threshold value; and a judgment medium configured to judge that a later frame among said two frames successive in the elapsed time is to be converted by said short blocks when said absolute value is larger than said threshold value as the comparison result obtained by said comparison medium, and that the judging cannot be performed when said absolute value is smaller than said threshold value.

6. The digital acoustic signal coding apparatus as defined in claim 3, wherein said threshold value is equal to a value determined per the sampling frequency of said input acoustic signal.

7. A method of coding digital acoustic signal in which a digital acoustic signal is inputted along a time axis and divided into blocks therealong, at least processes of subband division or conversion from time to frequency area are practiced per each of the respective blocks, said acoustic signal is divided into plural band widths, coded bits are allocated to each of said respective band widths, a normalized coefficient is obtained corresponding to the coded bit number of the allocated bits, and said digital acoustic signal is compressed and coded by quantizing said acoustic signal with said normalized coefficient, wherein, when the conversion to said frequency area is performed, said acoustic signal divided into the blocks is converted to either one of a long conversion block or plural short conversion blocks;

wherein, when said short conversion blocks are employed, said plural short conversion blocks are divided into the groups of plural blocks respectively including one or plural short conversion blocks;

wherein said acoustic signal is quantized, causing one or plural short conversion blocks included in the same group to correspond to a common normalized coefficient; and wherein said method of coding digital acoustic signal comprises the steps of:

calculating perceptual entropy of an input acoustic signal per each of said respective short conversion blocks;

obtaining a total sum in a frame of said calculated perceptual entropy;

comparing the absolute value of a difference between respective total sums of two frames of perceptual entropy that are successive in relation to an elapsed time with a previously determined threshold value; and judging whether said long block or said short blocks should be used to convert a block of said input acoustic signal on the basis of the comparison result.

8. The method of coding digital acoustic signal as defined in claim 7, wherein, when said absolute value is larger than said threshold value, a later frame among said two frames successive in the elapsed time is judged to be converted is judged to be converted by said long block, wherein, when said absolute value is smaller than said threshold value, the later frame among said two frames is judged to be converted by said long block.

9. The method of coding digital acoustic signal as defined in claim 8, wherein said threshold value is equal to a value determined per the sampling frequency of said input acoustic signal.

10. The method of coding digital acoustic signal as defined in claim 7, wherein said threshold value is equal to a value determined per the sampling frequency of said input acoustic signal.

11. A method of coding digital acoustic signal in which a digital acoustic signal is inputted along time axis and divided into blocks therealong, at least processes of sub-band division or conversion from time to frequency area are practiced per each of the respective blocks, said acoustic signal is divided into plural band widths, coded bits are allocated to each of said respective band widths, a normalized coefficient is obtained corresponding to the coded bit number of the allocated bits, and said digital acoustic signal is compressed and coded by quantizing said acoustic signal with said normalized coefficient, wherein, when the conversion to said frequency area is performed, said acoustic signal divided the blocks is converted to either one of a long conversion block or plural short conversion blocks;

wherein, when said short conversion blocks are employed, said plural short conversion blocks are divided into the groups of plural blocks respectively including one or plural short conversion blocks; wherein said acoustic signal is quantized, causing one or plural short conversion blocks included in the same group to correspond to a common normalized coefficient; and wherein said method of coding digital acoustic signal comprises the steps of:

calculating perceptual entropy of an input acoustic signal per each of said respective short conversion blocks;

obtaining a total sum in a frame of said calculated perceptual entropy;

comparing the absolute value of a difference between the respective total sums of two frames of perceptual entropy that are successive in relation to an elapsed time with a previously determined threshold value; and judging the later frame among said two frames successive in the elapsed time to be converted by said short blocks when said absolute value is larger than said threshold value, judging the later frame among said two frames successive in the elapsed time to be converted by said long block when said absolute value is larger than said threshold value.

12. The method of coding digital acoustic signal as defined in claim 11, wherein said threshold value is equal to a value determined per the sampling frequency of said input acoustic signal.

13. A recording medium for recording a program of coding the digital acoustic signal coding apparatus in which a digital acoustic signal is inputted along a time axis and divided into blocks therealong by use of a computer, processes including at least sub-band division or conversion from time area to frequency area are practiced per each of the respective blocks, said acoustic signal is divided into plural band widths, coded bits are allocated to each of said respective band widths, normalized coefficient is obtained corresponding to the coded bit number of the allocated bits, and said digital acoustic signal is compressed and coded by quantizing said acoustic signal with said normalized coefficient, wherein, when the conversion to said frequency area is performed, said acoustic signal divided into the blocks is converted to either one of a long conversion block or plural short conversion blocks;

wherein, when said short conversion blocks are employed, said plural short conversion blocks are divided into groups of plural blocks respectively including one or plural short conversion blocks;

wherein said acoustic signal is practiced to quantize causing one or plural short conversion blocks included in the same group to correspond to a common normalized coefficient; and wherein said recording medium has functions of:

calculating perceptual entropy of an input acoustic signal per each of said respective short conversion blocks;

obtaining a total sum of said calculated perceptual entropy in a frame;

comparing an absolute value of a difference between respective total sums of perceptual entropy of two frames that are successive in relation to an elapsed time with a previously determined threshold value; and judging whether said long block or said short blocks, should convert a block of said input acoustic signal on the basis of the comparison result.

14. A recording medium for recording a program of coding the digital acoustic signal coding apparatus in which a digital acoustic signal is inputted along a time axis and divided into blocks therealong by use of a computer, processes including at least sub-band division or conversion to frequency area are practiced per each of the respective blocks, said acoustic signal is divided into plural band widths, coded bits are allocated to each of said respective band widths, a normalized coefficient is obtained corresponding to the coded bit number of the allocated bits, and said digital acoustic signal is compressed and coded by quantizing said acoustic signal with said normalized coefficient, wherein, when the conversion to said frequency area is performed, said acoustic signal divided into the blocks is converted to either one of a long conversion block or plural short conversion blocks;

wherein, when said short conversion blocks are employed, said plural short conversion blocks are divided into groups of plural blocks respectively including one or plural short conversion blocks;

wherein said acoustic signal is practiced to quantize causing one or plural short conversion blocks included in the same group to correspond to a common normalized coefficient; and wherein said recording medium has functions of:

calculating perceptual entropy of an input acoustic signal per each of said respective short conversion blocks;

obtaining a total sum of said calculated perceptual entropy in a frame;

comparing an absolute value of a difference between respective total sums of perceptual entropy of two frames that are successive in relation to an elapsed time with a previously determined threshold value; and judging a later frame among said two frames successive in the elapsed time to be converted by said short blocks when said absolute value is larger than said threshold value, and judging the later frame among said two frames successive in the elapsed time to be converted by said long block when said absolute value is smaller than said threshold value.

15. A digital acoustic signal coding apparatus in which a digital acoustic signal is inputted along a time axis and divided into blocks therealong, at least one of said blocks undergoing conversion from a time area to a frequency area wherein said acoustic signal is divided into plural band widths, coded bits are allocated to each of said respective band widths, a normalized coefficient is obtained corresponding to the coded bit number of the allocated bits, and said digital acoustic signal is compressed and coded by quantizing said acoustic signal with said normalized coefficient, wherein, when the conversion to said frequency area is performed, said acoustic signal divided into blocks is converted to either one of a long conversion block or plural short conversion blocks;

wherein, when said short conversion blocks are employed, said plural short conversion blocks are divided into the groups of plural blocks respectively including one or plural short conversion blocks;

wherein said acoustic signal is quantized causing one or plural short conversion block included in the same group to correspond to a common normalized coefficient; and wherein said digital acoustic signal coding apparatus comprises:

perceptual entropy calculation means for calculating perceptual entropy of an input acoustic signal per each of said respective short conversion blocks;

perceptual entropy total sum calculation means for obtaining a total sum of perceptual entropy in a frame;

comparison means for comparing an absolute value of the difference between respective total sums of two frames that are successive in relation to an elapsed time with a previously determined threshold value; and long/short block judgment means for judging whether said long block or said short blocks should be used to convert at least one block of said input acoustic signal on the basis of the comparison result obtained by said comparison means.

16. The digital acoustic signal coding apparatus as defined in claim 15, wherein, when said absolute value is larger than said threshold value as the comparison result obtained by said comparison means, said long/short blocks judgment means judges that the later frame among said two frames successive in the elapsed time is converted by said short blocks; and wherein, when said absolute value is smaller than said threshold value, said long/short blocks judgment means judges that the later frame among said two frames is converted by said long block.

17. The digital acoustic signal coding apparatus as defined in claim 16, wherein said threshold value is equal to a value determined per the sampling frequency of said input acoustic signal.

18. The digital acoustic signal coding apparatus as defined in claim 15, wherein said threshold value is equal to a value determined per the sampling frequency of said input acoustic signal.

19. A digital acoustic signal coding apparatus in which a digital acoustic signal is inputted along a time axis and divided into blocks therealong, with at least one block being processed for conversion from a time area to frequency area wherein said acoustic signal is divided into plural band widths, coded bits are allocated to each of said respective band widths, a normalized coefficient is obtained corresponding to the coded bit number of the allocated bits, and said digital acoustic signal is compressed and coded by quantizing said acoustic signal with said normalized coefficient, wherein, when the conversion to said frequency area is performed, at least said at least one block of said acoustic signal divided into the blocks is converted to either one of a long conversion block or plural short conversion blocks;

wherein, when said short conversion blocks are employed, said plural short conversion blocks are divided into groups of plural blocks respectively including one or plural short conversion blocks;

wherein said acoustic signal is quantized, causing one or plural short conversion blocks included in the same group to correspond to a common normalized coefficient; and wherein said digital acoustic signal coding apparatus comprises:

perceptual entropy calculation means for calculating the perceptual entropy of an input acoustic signal per each of said respective short conversion blocks;

perceptual entropy total sum calculating means for obtaining a total sum of entropy in a frame;

comparison means for comparing an absolute value of the difference between respective total sums of perceptual entropy of two frames that are successive in relation to an elapsed time with a previously determined threshold value; and judgment means for judging that a later frame among said two frames successive in the elapsed time is converted by said short blocks when said absolute value is larger than said threshold value as the comparison result obtained by said comparison means, and that judgment cannot be performed by the judging means when said absolute value is smaller than said threshold value.

20. The digital acoustic signal coding apparatus as defined in claim 17, wherein said threshold value is equal to a value determined per the sampling frequency of said input acoustic signal.

21. A method comprising the steps of:

inputting a digital acoustic signal along a time axis;

dividing said digital acoustic signal into blocks therealong by use of a computer;

practicing processes including sub-band division or conversion from a time area to a frequency area, per each of the respective blocks;

dividing said acoustic signal into plural band widths;

allocating coded bits to each of said respective band widths;

obtaining a normalized coefficient corresponding to the coded bit number of the allocated bits; and compressing and coding said digital acoustic signal by quantizing said acoustic signal with said normalized coefficient, wherein, when the conversion to said frequency area is performed, said acoustic signal divided into the blocks is converted to either one of a long conversion block or plural short conversion blocks;

wherein, when said short conversion blocks are employed, said plural short conversion blocks are divided into groups of plural blocks respectively including one or plural short conversion blocks;

wherein said acoustic signal is practiced to quantize causing one or plural short conversion block included in the same group to correspond to a common normalized coefficient; and wherein said method further comprising the steps of:

calculating perceptual entropy of an input acoustic signal calculated per each of said respective short conversion blocks;

obtaining a total sum in a frame of said calculated perceptual entropy;

comparing an absolute value of a difference between respective total sums of perceptual entropy of frames that being successive in relation to an elapsed time with a previously determined threshold value; and judging whether said long block or said short blocks should be used to convert a block of said input acoustic signal on the basis of the comparison result.

22. A method comprising the steps of:

inputting a digital acoustic signal along time axis;

dividing said digital acoustic signal into blocks therealong by use of a computer;

practicing processes including such as sub-band division or conversion from a time area to frequency area, per each of the respective blocks;

dividing said acoustic signal into plural band widths;

allocating coded bits to each of said respective band widths;

obtaining a normalized coefficient, corresponding to the coded bit number of the allocated bits; and compressing and coding said digital acoustic signal by quantizing said acoustic signal with said normalized coefficient, wherein, when the conversion to said frequency area is performed, said acoustic signal divided into the blocks is converted to either one of a long conversion block or plural short conversion blocks;

wherein, when said short conversion blocks are employed, said plural short conversion blocks are divided into groups of plural blocks respectively including one or plural short conversion blocks;

wherein said acoustic signal is practiced to quantize causing one or plural short conversion block included in the same group to correspond to a common normalized coefficient; and wherein said method further comprising the steps of:

calculating perceptual entropy of an input acoustic signal calculated per each of said respective short conversion blocks;

obtaining a total sum in a frame of said calculated perceptual entropy;

comparing an absolute value of a difference between respective total sums of perceptual entropy of two frames that are successive in relation to an elapsed time with a previously determined threshold value; and judging a later frame among said two frames successive in the elapsed time to be converted by said short blocks when said absolute value is larger than said threshold value, and judging the later frame among said two frames successive in the elapsed time to be converted by said long block when said absolute value is smaller than said threshold value.

* * * * *